US011891792B2

(12) United States Patent
Teffenhart, Jr.

(10) Patent No.: US 11,891,792 B2
(45) **Date of Patent: *Feb. 6, 2024**

(54) SYSTEM AND METHOD HAVING AN IMPROVED BEAM AND BEAM COUPLING SYSTEM

(71) Applicant: Thomas Joseph Teffenhart, Jr., Sarasota, FL (US)

(72) Inventor: Thomas Joseph Teffenhart, Jr., Sarasota, FL (US)

( * ) Notice: Subject to any disclaimer, the term of this patent is extended or adjusted under 35 U.S.C. 154(b) by 34 days.

This patent is subject to a terminal disclaimer.

(21) Appl. No.: 17/343,936

(22) Filed: Jun. 10, 2021

(65) Prior Publication Data

US 2021/0302344 A1 Sep. 30, 2021

Related U.S. Application Data

(63) Continuation of application No. 16/829,650, filed on Mar. 25, 2020, now Pat. No. 11,614,419, which is a continuation of application No. 16/014,384, filed on Jun. 21, 2018, now Pat. No. 10,640,968.

(51) Int. Cl.

| | |
|---|---|
| ***E04B 1/19*** | (2006.01) |
| ***E04B 1/24*** | (2006.01) |
| ***E04B 1/38*** | (2006.01) |

(52) U.S. Cl.

CPC ..... *E04B 1/1906* (2013.01); *E04B 1/2403* (2013.01); *E04B 1/388* (2023.08); *E04B 2001/1933* (2013.01); *E04B 2001/1963* (2013.01); *E04B 2001/1984* (2013.01); *E04B 2001/2406* (2013.01); *E04B 2001/2421* (2013.01); *E04B 2001/2448* (2013.01); *E04B 2001/2457* (2013.01)

(58) Field of Classification Search

CPC ..... E04B 1/2403; E04B 1/40; E04B 1/1906; E04B 1/388

See application file for complete search history.

(56) References Cited

U.S. PATENT DOCUMENTS

| | | | |
|---|---|---|---|
| 1,788,096 | A | 1/1931 | Friedemann |
| 1,997,876 | A | 4/1935 | Sheldon |
| 3,139,960 | A | 7/1964 | Hammitt et al. |
| 3,143,165 | A | 8/1964 | Lewis et al. |
| 3,222,841 | A | 12/1965 | Robert |
| 3,224,154 | A | 12/1965 | Toti et al. |
| 3,332,197 | A | 7/1967 | Hinkle |
| 3,382,639 | A | 5/1968 | Smith et al. |
| 3,413,775 | A | 12/1968 | Katz |
| 3,566,561 | A | 3/1971 | Tozer |
| 3,686,805 | A | 8/1972 | Pofferi |
| 3,711,133 | A | 1/1973 | Werner |
| 3,726,551 | A | 4/1973 | Levenberg |
| 3,830,033 | A | 8/1974 | Gahler |
| 3,831,336 | A | 8/1974 | Diemer |
| 3,866,364 | A | 2/1975 | Pollard |
| 4,002,000 | A | 1/1977 | Howard et al. |
| 4,027,987 | A | 6/1977 | Berkowitz |
| 4,057,941 | A | 11/1977 | Schwartz |
| 4,112,853 | A | 9/1978 | Tisbo et al. |

(Continued)

*Primary Examiner* — Beth A Stephan

(74) *Attorney, Agent, or Firm* — Jacox, Meckstroth & Jenkins

(57) ABSTRACT

A building system that utilizes an improved beam and coupling system for building a frame or structure having improved strength and durability and improving performance and/or spanning distance of the beam.

41 Claims, 27 Drawing Sheets

(56) References Cited

U.S. PATENT DOCUMENTS

| | | | |
|---|---|---|---|
| 4,242,969 | A | 1/1981 | Checkwood et al. |
| D259,083 | S | 5/1981 | Riegsecker |
| 4,270,872 | A | 6/1981 | Kiyosawa |
| 4,323,319 | A | 4/1982 | Adams |
| 4,368,998 | A | 1/1983 | Pestoor |
| 4,516,376 | A | 5/1985 | King |
| 4,630,550 | A | 12/1986 | Weitzman |
| D294,888 | S | 3/1988 | Kazanowski |
| 4,774,790 | A | 10/1988 | Hopper |
| 4,987,717 | A | 1/1991 | Dameron, Jr. |
| 5,031,083 | A | 7/1991 | Claesson |
| 5,090,164 | A | 2/1992 | Mische |
| D343,909 | S | 2/1994 | Flynn |
| 5,464,302 | A | 11/1995 | Menchetti |
| D373,832 | S | 9/1996 | Nomura |
| D374,488 | S | 10/1996 | Wang |
| 5,590,974 | A | 1/1997 | Yang |
| 5,813,641 | A | 9/1998 | Baldwin |
| 5,881,508 | A | 3/1999 | Irvine et al. |
| D414,881 | S | 10/1999 | Giese |
| 5,966,890 | A | 10/1999 | Inman |
| 5,997,117 | A | 12/1999 | Krietzman |
| 6,082,070 | A | 7/2000 | Jen |
| 6,092,348 | A | 7/2000 | Dombchik et al. |
| 6,357,196 | B1 | 3/2002 | McCombs |
| 6,385,941 | B1 | 5/2002 | Power, Jr. et al. |
| 6,405,504 | B1 | 6/2002 | Richardson |
| 6,430,888 | B1 | 8/2002 | Dombchik et al. |
| 6,601,362 | B1 | 8/2003 | Prince |
| 6,647,692 | B1 | 11/2003 | Roder |
| 6,668,495 | B1 | 12/2003 | Prince |
| 6,755,004 | B1 | 6/2004 | Power, Jr. et al. |
| D493,235 | S | 7/2004 | Strassle |
| 6,826,885 | B2 | 12/2004 | Raskin et al. |
| D531,324 | S | 10/2006 | Takagi |
| D584,621 | S | 1/2009 | Jean |
| 7,478,504 | B2 | 1/2009 | Huebner et al. |
| 7,568,323 | B2 | 8/2009 | Shelton et al. |
| 7,628,563 | B2 | 12/2009 | Winkler |
| 7,708,317 | B2 | 5/2010 | Leblanc |
| 7,743,538 | B2 | 6/2010 | Parenti et al. |
| D620,618 | S | 7/2010 | Teffenhart, Jr. |
| D620,619 | S | 7/2010 | Teffenhart, Jr. |
| 7,870,699 | B2 | 1/2011 | Waggoner |
| 7,877,962 | B2 | 2/2011 | Teffenhart, Jr. |
| 7,883,288 | B2 | 2/2011 | Jorna |
| D636,095 | S | 4/2011 | Teffenhart, Jr. |
| D666,743 | S | 9/2012 | Teffenhart, Jr. |
| D670,474 | S | 11/2012 | Koch |
| 8,443,576 | B2 | 5/2013 | Petta |
| 8,720,839 | B2 | 5/2014 | Lijesnic |
| 8,726,583 | B2 | 5/2014 | Verdecia et al. |
| 8,756,900 | B1 | 6/2014 | Hudson et al. |
| D713,054 | S | 9/2014 | Teffenhart, Jr. |
| D731,678 | S | 6/2015 | Geldart |
| D733,937 | S | 7/2015 | Hillstrom et al. |
| 9,121,222 | B2 | 9/2015 | Walker et al. |
| D744,317 | S | 12/2015 | Densberger et al. |
| 9,458,619 | B2 | 10/2016 | Bowron et al. |
| D791,342 | S | 7/2017 | Teffenhart, Jr. |
| D811,199 | S | 2/2018 | Bacallao |
| 9,920,534 | B2 | 3/2018 | Albert |
| D860,058 | S | 9/2019 | Norfleet et al. |
| D882,386 | S | 4/2020 | Zeilinger |
| 2002/0046539 | A1 | 4/2002 | Schulz |
| 2002/0121068 | A1 | 9/2002 | Ng |
| 2003/0145555 | A1 | 8/2003 | Raskin et al. |
| 2006/0179766 | A1 | 8/2006 | Waggoner |
| 2007/0074480 | A1 | 4/2007 | Kleila et al. |
| 2007/0266671 | A1 | 11/2007 | Chromy |
| 2008/0016816 | A1 | 1/2008 | Kim |
| 2008/0168738 | A1 | 7/2008 | Shelton et al. |
| 2008/0250737 | A1 | 10/2008 | Hall et al. |
| 2009/0178360 | A1 | 7/2009 | Teffenhart, Jr. |
| 2011/0036050 | A1 | 2/2011 | Callahan |
| 2011/0036051 | A1 | 2/2011 | Callahan |
| 2011/0036052 | A1 | 2/2011 | Callahan |
| 2011/0113717 | A1 | 5/2011 | Teffenhart, Jr. |
| 2013/0306808 | A1 | 11/2013 | Huang |
| 2017/0097030 | A1 | 4/2017 | Keller |
| 2019/0116861 | A1 | 4/2019 | Zeilinger |

SYSTEM AND METHOD HAVING AN IMPROVED BEAM AND BEAM COUPLING SYSTEM

CROSS-REFERENCE TO RELATED APPLICATIONS

The present application is a continuation of U.S. application Ser. No. 16/829,560, filed Mar. 25, 2020, now issued as U.S. Pat. No. 11,072,922, which is a continuation of U.S. application Ser. No. 16/014,384, filed Jun. 21, 2018, now issued as U.S. Pat. No. 10,640,968, to which Applicant claims the benefit of the earlier filing date. This application is incorporated herein by reference and made a part hereof.

BACKGROUND OF THE INVENTION

1. Field of the Invention

This invention relates to a building system, and more particularly, to a system that utilizes an improved beam and coupling system for building a frame or structure.

2. Description of the Related Art

The aluminum enclosure industry and patio screen enclosure roof systems typically utilized beams comprising two identical halves. The halves simply overlap and were stitched or screwed together with a plurality of screws to make one complete self-mating beam. In some applications, an entire extruded one-piece beam was used.

One problem with the prior art beam structures is a high failure rate during strong winds, especially hurricane-force winds. The box beam failed for many reasons including the fact that the beam web was simply overlapped and laid on top of each other. An improved beam system that overcame some problems of the prior art is shown in U.S. Pat. No. 7,877,962; U.S. Design Pat. Nos. D620,618; D620,619; D636,095; D666,743; D713,054 and D791,342, all of which are incorporated herein by reference and made a part hereof.

The beam structures of the prior art had to use a plurality of horizontal and vertical beams to create a frame onto which a mesh screen was mounted. Typically, a top spanning horizontal beam could only span approximately six to ten feet before a vertical column support or column beam had to be used to support the weight of the top beam. One problem with the designs and structures of the prior art is that the number of vertical and horizontal beams obstructed the view of persons inside the structure who were looking out. For example, if the structure was a lanai structure, it is not uncommon that people in the lanai like to view the scenery outside of the lanai, whether it be a scenic water view, a golf course view or a wooded area view, but the vertical and horizontal columns were aesthetically unpleasing and at least partially obstructed that view.

Another problem is that oftentimes main spanning beams typically did not have spline grooves and a separate beam having the spline grooves had to be secured thereto and used, adding parts and manufacturing costs to the structure. For example, it was not uncommon that a 1"×2" beam having at least one or a plurality of spline grooves for receiving and securing the screen to the beams had to be mounted on top of a primary support beam that would be used for building the structure frame. The additional lanai screen beam was typically mounted onto the primary support beam and provided the spline groove or channel that was necessary to mount the mesh screen onto the frame. Of course, the additional 1"×2" beam having the spline groove also added additional material and installation cost to the framing structure.

To overcome some of these problems, some attempts have been made to make the beams more robust by, for example, making the beam walls much thicker, so that they withstand longer span lengths. Several problems arise with increasing the size of the beams, including increased weight and cost to name a few. As the length of the beams increased along with the need to carry heavier loads, bigger and heavier beams had to be created. As enclosure sizes and span lengths increase, the box and hollow beams that were used to make the enclosures in the past had to be made with much thicker and heavier extrusions in order to achieve the span lengths desired. Unfortunately, these extrusions were typically more expensive and resulted in increased costs.

Some homeowners or builders are building larger and more dynamic structures, such as pool enclosures and lanais, with the same historical products, resulting in structures that have undesirable viewing obstructions, failure rates and/or costs.

Another problem with the typical beams of the past is that they had to utilize through-bolts and fascia fasteners to secure the beams together or to another structure. The through-bolts and fascia fasteners are aesthetically unpleasing.

Still another problem is that a typical building structure that was framed using a prior art beam system had to utilize steel cables or tie-downs for lateral structural support. The lateral tie-downs added material and installation costs to the overall structure.

Still another problem with the prior art framing structures is that the beams typically had to be mounted to other structures, such as a patio deck, floor or wall using a plurality of L-shaped brackets situated on opposite sides of the beam and fastened thereto and to the other structure. These brackets and fastenings all added additional installation time and cost. Some people found the mounting brackets to be aesthetically unpleasing as well.

There is, therefore, a need to provide an improved building structure having an improved beam and coupling system that overcomes one or more of the problems of the prior art.

SUMMARY OF THE INVENTION

One object of the invention is to provide an improved beam and coupling system for building a structure.

Another object of the invention is to provide a beam and coupling system that can span greater lengths.

Still another object of the invention is to provide a stronger beam and coupling system that has a large viewing area that is uninterrupted by horizontal or vertical support beams of the type used in the prior art.

Still another object of the invention is to provide a beam and coupling system that eliminates the need for fasteners on the fascia sides of the beam.

Still another object of the invention is to provide a beam and coupling system for making a frame that reduces or eliminates the need for through-fasteners or fasteners that are screwed into the fascia sides of the beam.

Still another object of the invention is to provide an improved beam and coupler system for creating a frame that reduces or eliminates the need for tie-down cables.

Another object of the invention is to provide a corner coupler for securing a plurality of beams together to form a corner of the framing structure.

Another object of the invention is to provide an elongated coupler for coupling or splicing two beams together.

Yet another object of the invention is to provide a coupler having at least a portion that can be mounted to a support structure, such as a patio deck, concrete slab, building wall, structure or the like.

Another object of the invention is to provide a system and method for coupling beams together to form a frame wherein a dimension of at least one coupler used with at least one beam and wherein a length of the coupler is directly proportional to a span length of the beam, such that a length of the coupler is directly proportional to a span length of the beam.

Another object of the invention is to provide improved couplers and a coupling system for coupling beams together or to a surface or structure.

Another object of the invention is to provide an improved beam that reduces or eliminates the need for additional screen support beams or systems.

In one aspect, one embodiment of the invention comprises a universal reinforcement coupling for use with at least one support beam used in building a structure, comprising a coupling for inserting into the at least one support beam, the coupling comprising a plurality of coupling surfaces that become positioned in operative relationship with a plurality of internal surfaces of the at least one support beam, and the at least one support beam being adapted and sized to receive the coupling.

In another aspect, another embodiment of the invention comprises a building system comprising at least one support beam having a plurality of beam walls defining a plurality of internal wall surfaces, respectively, that cooperate to define a beam aperture, and at least one coupling adapted and dimensioned to be received in the beam aperture, the at least one coupling comprising a plurality of coupling surfaces that become positioned in operative relationship with the plurality of internal wall surfaces, respectively, of the at least one support beam to facilitate enhancing a performance or characteristic of the at least one support beam.

In still another aspect, another embodiment of the invention comprises a building system for building a structure, the building system comprising at least one first support beam, at least one second support beam, and at least one coupler for coupling the first support beam to the second support beam together, the at least one coupler having at least a portion defining a predetermined configuration defining a first end adapted to be inserted into an end of the at least one first support beam and a second portion adapted to be inserted into an end of the second support beam, the at least one coupler facilitating improving at least one performance characteristic of the joined beams.

In yet another aspect, another embodiment of the invention comprises a coupler for use with at least one support beam of a building structure, the coupler comprising a body having at least a portion that is sized and adapted to fit into at least one end of the at least one support beam and to engage the internal walls thereof in order to buttress or support the at least one support beam, the body comprising a web having a first flange on a first end of the web and a second flange on a second end of the web, the first and second flanges each having a primary flange surface and at least one flange wall surface integrally or monolithically formed with the primary flange surface, and the at least one first flange wall surface being generally perpendicular to the primary flange surface.

In another aspect, another embodiment of the invention comprises a structure comprising a plurality of beams, and a plurality of internal couplers for coupling the plurality of beams together, the plurality of internal couplers each having a first end dimensioned and sized to be press fit or received in a first end of a first one of the plurality of beams and having a second end that is at least one of: adapted to be fixed to a support to mount the first end of the first one of the plurality of beams to a support surface or is sized to be press fit or received in a first end of a second one of the plurality of beams in order to secure the first one of the plurality of beams to a second one of the plurality of beams.

In another aspect, another embodiment of the invention comprises a beam comprising a body having a plurality of spline grooves, the plurality of spline grooves being oriented in order to support a roof screen and a wall screen.

In another aspect, another embodiment of the invention comprises a building system comprising at least one fastener for securing at least one support beam to at least one coupling, at least one fastener passing through only one of at least one plurality of beam walls before engaging the at least one coupling and does not pass through another of the at least one of the plurality of beam walls.

In another aspect, another embodiment of the invention comprises a building system comprising at least one support beam having a plurality of beam walls defining a plurality of internal wall surfaces, respectively, that cooperate to define a beam aperture, and at least one coupling adapted and dimensioned to be received in the beam aperture, the at least one coupling comprising a plurality of coupling surfaces that become positioned in operative relationship with the plurality of internal wall surfaces, respectively, of the at least one support beam to facilitate enhancing a performance or characteristic of the at least one support beam, the at least one coupling increasing an operation performance of the at least one support beam, thereby reducing or eliminating a need for cable tie-downs.

This invention, including all embodiments shown and described herein, could be used alone or together and/or in combination with one or more of the features covered by one or more of the following list of features:

- The universal reinforcement coupling wherein the coupling is a corner coupler, a splicing coupler or a support coupler.
- The universal reinforcement coupling wherein each of the support coupler, the splicing coupler and the corner coupler have at least a portion that is generally in the shape of an I in cross-section.
- The universal reinforcement coupling wherein the coupling comprises at least a portion generally shaped as an I in cross-section and has a first flange, a generally opposing second flange and a web for joining the first and second flanges, the first and second flanges being generally U-shaped in cross section.
- The universal reinforcement coupling wherein each of the generally U-shaped in cross-section first and second flanges comprise at least one beveled corner.
- The universal reinforcement coupling wherein each of the generally U-shaped in cross-section flanges comprise a plurality of beveled corners.
- The universal reinforcement coupling wherein the coupling comprises a web and a first flange located on a first end of the web and a second flange located on a second end of the web, each of the first and second flanges being generally perpendicular to the web and generally parallel to each other, at least one of the first flange or the second flange having a flange wall that extends generally parallel to the web.

The universal reinforcement coupling wherein at least one of the first flange or the second flange has at least one flange wall that extends generally parallel to the web.

The universal reinforcement coupling wherein at least one of the first flange or the second flange has a plurality of flange walls that extend generally parallel to the web and cooperate with a generally planar portion of the first flange or a generally planar portion of the second flange define a general U-shape in cross-section at each end of the web, the general U-shape of the first flange being generally opposed to the general U-shape of the second flange.

The universal reinforcement coupling wherein the coupling is sized and adapted to received inside an end of the at least one support beam.

The universal reinforcement coupling wherein the coupling comprises a beam generally shaped as an I-beam having a first flange and a generally opposing second flange, the first and second flanges each being generally U-shaped in cross section and each comprising a flange having a first flange wall, a second flange wall and a joining flange portion for joining the first and second flange walls, the first and second flange walls having at least one wall surface that becomes generally opposed and adjacent to a first internal beam wall surface and a second internal beam wall surface, respectively.

The universal reinforcement coupling wherein at least a portion of the coupling generally defines an I-beam in cross-section, the coupling being generally L-shaped and defines a corner coupling for coupling the at least one support beam to a second support beam such that their axes are not co-axial.

The universal reinforcement coupling wherein at least a portion of the coupling generally defines an I-beam shape in cross-section having a first end that is received in the I-beam and a second end that is fixed or mounted to a support surface, the first end being dimensioned and adapted for receipt in the at least one support beam.

The universal reinforcement coupling wherein the coupling is a splice coupling and at least a portion of the coupling comprises a first flange and a generally opposing second flange, the coupling being adapted to splice and support the at least one support beam to a second support beam such that their axes are coaxial and define an elongated beam.

The universal reinforcement coupling wherein the at least one support beam comprises an internal beam structure extending at least part of a length into the at least one support beam, at least a portion of the coupling having a predetermined shape to cooperate with at least one internal surface of the at least one support beam to define an aperture into which the internal beam structure may be received.

The universal reinforcement coupling wherein at least a portion of the coupling generally has a first flange and a generally opposing second flange, the first and second flanges having at least one recessed area, beveled corner or edge adapted to cooperate with at least one wall of the at least one support beam to define an internal channel.

The building system wherein the at least one coupling is a corner coupler, a splicing coupler or a support coupler.

The building system wherein each of the support coupler, the splicing coupler and the corner coupler have at least a portion that is generally in the shape of an I in cross-section.

The building system wherein at least a portion of the at least one coupling generally defines an I shape in cross-section adapted and dimensioned to be inserted in the at least one support beam.

The building system wherein at least a portion of the at least one coupling has at least a portion that is generally shaped like an I-beam having a first flange, a generally opposing second flange and a web coupling the first and second flanges, the first and second flanges being generally U-shaped in cross section and each comprising a first flange wall and a second flange wall and flange joining portion for joining the first and second flange walls, the plurality of internal wall surfaces comprising a first internal beam wall surface, a second internal beam wall surface and a third internal beam wall surface, and the first and second flange walls each having at least one surface that becomes generally opposed or adjacent to the first internal beam wall surface and the second internal beam wall surface, respectively, the flange joining portion becoming generally opposed or adjacent the third internal beam wall surface.

The building system wherein at least a portion of the at least one coupling defines an I-beam configuration in cross-section and the at least one coupling is generally L-shaped to define a corner coupling for coupling the at least one support beam to a second beam.

The building system wherein the at least one coupling comprises a first portion and a second portion that cooperate to define the L-shape, each of the first and second portions generally having at least a portion having an I-beam shape in cross-section.

The building system wherein the at least one coupling is a support coupling having a first end having at least a portion that defines a generally I-beam shape that is received in the at least one support beam and a second end that is fixed or mounted to a support surface.

The building system wherein the at least one coupling has a first flange and a generally opposing second flange, at least one of the first and second flanges being generally U-shaped in cross section, the at least one coupling being a splice coupling adapted to splice together the at least one support beam to a second support beam.

The building system wherein the at least one support beam comprises an internal beam structure extending at least part of a length of the at least one support beam, the at least one coupling having a predetermined shape to cooperate with at least one of the plurality of internal wall surfaces of the at least one support beam to define an aperture into which the internal beam structure may be received.

The building system wherein the internal beam structure is a retaining channel or spline groove.

The building system wherein the at least one coupling comprises at least a portion that defines a general I-beam shape having at least one flange having at least one beveled corner or edge that defines the predetermined shape.

The building system wherein the at least one coupling comprises at least a portion having a general shape of an I-beam with a first flange and a second flange, at least one of the first flange or second flange having at least one truncated or beveled corner adapted to accommodate an internal beam structure on at least one of the plurality of internal wall surfaces.

The building system wherein the at least one coupling comprises an I-beam and has a first portion and a second portion, a dimension or size of at least one of the first portion or the second portion being selected in response to a dimension or size of the at least one support beam.

The building system wherein the at least one coupling comprises a first portion having a first axis and a second portion having a second axis, the first and second axes being angled a predetermined angle with respect to each other.

The building system wherein the predetermined angle is about generally about 90 degrees so that the at least one coupling defines at least one corner coupling.

The building system wherein the first portion or the second portion generally defines an I-beam shape in cross-section having generally U-shaped flanges.

The building system wherein the at least one coupling has a second portion that also generally defines an I-beam shape in cross-section and has generally U-shaped flanges, the first and second portions being generally orthogonal with respect to each other.

The building system wherein the at least one coupling has a second portion that also generally defines an I-beam shape in cross-section and has generally U-shaped flanges, the first and second portions having axes that are generally coaxial.

The building system wherein the building system comprises at least one fastener for securing the at least one support beam to the at least one coupling, the at least one fastener passing through only one of the plurality of beam walls before engaging the at least one coupling and does not pass through another of the at least one of the plurality of beams walls.

The building system wherein the at least one fastener comprises a plurality of fasteners and the plurality of beam walls defines a plurality of fascia walls and a plurality of non-fascia or end walls, each of the plurality of fasteners comprising being mounted in one of the plurality of non-fascia or end walls and not any of the plurality of fascia walls.

The building system wherein a length of the at least one support beam is directly related to at least one dimension of at least a portion of the at least one coupling that is received in the at least one support beam.

The building system wherein the at least one dimension of the at least one coupling is a length of the portion of the at least one coupling that passes into the at least one support beam.

The building system wherein the at least one coupling is a corner coupler dimensioned and adapted to provide a corner coupling of the at least one support beam having a coupling strength that eliminates a need for any cable tie downs.

The building system wherein each of the at least one support beam has a plurality of spline grooves adapted to receive a spline for securing a screen onto the support beam.

The building system wherein the plurality of spline grooves comprise a first spline groove situated on a first end wall of each of the at least one support beam and a second spline groove situated on a side fascia wall of each of the at least one support beam.

The building system wherein the at least coupling comprises an insert end for inserting into at least one of the at least one support beam and a mounting end for mounting to a surface or substrate.

The building system wherein the surface or substrate is a deck or floor surface or building surface onto which the mounting end is mounted when the insert end is inserted into the at least one of the at least one support beam.

The building system wherein the at least one coupler is a corner coupler, a splicing coupler or a support coupler.

The building system wherein each of the support coupler, the splicing coupler and the corner coupler have at least a portion that is generally in the shape of an I in cross-section.

The building system wherein the predetermined configuration of the at least one coupler defines a general L-shape for coupling the first support beam to the second support beam to define a corner of the structure.

The building system wherein the predetermined configuration of the at least one coupler is generally straight or linear for splicing a first end of the first support beam to a first end of the second support beam such that axes of the first and second support beam are generally coaxial.

The building system wherein each of the first support beam and the second support beam comprise a plurality of beam walls having a plurality of internal wall surfaces that cooperate to define a beam aperture in each of the first support beam or the second support beam, and the at least one coupler being adapted and dimensioned to be received in each of the beam apertures, the at least one coupler comprising a plurality of coupling surfaces that become positioned in operative relationship with the plurality of internal wall surfaces, respectively, of the at least one support beam to facilitate enhancing a performance of the at least one support beam.

The building system wherein the at least one coupler defines a generally I-beam shape in cross-section that is adapted and dimensioned to be inserted into the first and second support beams.

The building system wherein the at least one coupler comprises at least a portion that defines a first flange, a generally opposing second flange, and a web coupling the first and second flanges, the first and second flanges being generally U-shaped in cross section and each comprising a first flange wall, a second flange wall and a flange joining portion for joining the first and second flange walls, each of the first flange walls becoming generally opposed or adjacent to a first internal beam wall surface of the at least one support beam, the second flange wall becoming generally opposed to a second internal beam wall surface of the at least one support beam, the flange joining portion becoming generally opposed or adjacent to a third internal beam wall surface adapted to receive at least one fastener for fastening the at least one support beam to the at least one coupler.

The building system wherein the at least one coupler is generally L-shaped and defines a corner coupling for coupling the at least one support beam to a second support beam.

The building system wherein the at least one coupler comprises a first flange and a generally opposing second flange, the first and second flanges being generally U-shaped in cross section, the at least one coupler being adapted to splice together and couple the first support beam to the second support beam.

The building system wherein at least one of the first support beam or the second support beam comprises an internal beam structure extending at least part of a length of the at least one support beam, the at least one coupler cooperating with at least one internal surface of the at least of the first support beam or the second support beam to define an aperture into which the internal beam structure may be received.

The building system wherein the at least one of the first flange or second flange comprises at least one beveled corner or edge that defines a predetermined shape.

The building system wherein the at least one coupler comprises a beam having at least a portion that defines a first flange and a second flange, at least one of the first flange or second flange having at least one truncated or beveled corner adapted to accommodate an internal beam structure of the at least one first support beam or the second support beam.

The building system wherein at least a portion of the at least one coupler generally comprises an I-beam shape having a first portion and a second portion, a dimension of at least one of the first portion or the second portion being directly proportional to a dimension of at least one of the first support beam or the second support beam.

The building system wherein the at least one first and the second support beams have generally the same cross-sectional dimension, regardless of length.

The building system wherein the first and second support beams have different cross-sectional dimensions, regardless of length.

The building system wherein the building system comprises a plurality of couplers each of which comprises a portion that generally comprises an I-beam shape, a first one of plurality of couplers being a support coupler for inserting into the first support beam and having a second end of the first support beam being fastened or secured to a support, a second one of the plurality of couplers being either a splice coupler or a corner coupler adapted and sized to be received into a second end of the first support beam and into a first end of the second support beam, thereby coupling the first and second support beams together to define either an elongated joined beam or a corner of the structure.

The building system wherein the structure defines at least one of a lanai, screen enclosure, car port, walkway cover or outdoor cover.

The coupler wherein the coupler is a corner coupler, a splicing coupler or a support coupler.

The coupler wherein each of the support coupler, the splicing coupler and the corner coupler have at least a portion that is generally in the shape of an I in cross-section.

The coupler wherein each of the at least one flange wall surface comprises a first flange wall and a second flange wall, both of which project from the primary flange surface, the primary flange surface and the at least one first and second flange wall surfaces cooperate to define a general U-shape.

The coupler wherein the coupler comprises a beveled, angled or curved wall surface that joins or couples the first and second flange wall surfaces and the primary flange surface.

The coupler wherein the beveled, angled or curved wall surface cooperates with at least one internal surface of the at least one support beam to define an elongated aperture for accommodating or receiving an internal beam structure of the at least one support beam.

The structure wherein at least one of plurality of internal couplers is a corner coupler, a splicing coupler or a support coupler.

The structure wherein each of the support coupler, the splicing coupler and the corner coupler have at least a portion that is generally in the shape of an I in cross-section.

The structure wherein at least one of the plurality of internal couplers is generally L-shaped corner coupler so that when it is received in the first ends of the first one of the plurality of beams and the second one of the plurality of beams, it causes the beams to define a corner or elbow of the structure.

The structure wherein at least one of the plurality of internal couplers is configured to engage a plurality of internal wall surfaces of any of the plurality of beams in which it is inserted.

The structure wherein each of the plurality of beams comprises at least a first portion that is generally in a shape of an I in cross-section and is sized and adapted to engage a plurality of internal surfaces of at least one of the plurality of beams when it is inserted therein.

The structure wherein each of the plurality of internal couplers comprises a first flange and a second flange integrally or monolithically formed in the web, at least one of the first flange or the second flange having at least one wall surface that is generally perpendicular to the first flange or the second flange, respectively, and generally parallel to the web.

The structure wherein each of the first and second flanges comprise a plurality of surfaces that are parallel to the web.

The structure wherein each of the first and second flanges have a plurality of flange walls generally opposing the web, each of the first flange, the second flange, and the plurality of flange walls engaging a first beam wall surface, a second beam wall surface and a third beam wall surface, respectively, of one of the plurality of beams into which the coupler has been inserted.

The structure wherein each of the first and second flanges have a plurality of generally orthogonal flange walls, each of the first flange, the second flange, and the plurality of flange walls engaging a plurality of internal beam wall surfaces, respectively, when each of the plurality of internal couplers are inserted therein.

The structure wherein each of the first and second flanges have a truncated or beveled edge portion that cooperates with at least one of the plurality of internal beam wall surfaces to define a channel or aperture adapted to receive a beam structure from at least one of the plurality of beams.

The structure wherein the structure defines at least one of a lanai, screen enclosure, car port, walkway cover or outdoor cover.

The structure wherein at least one of the plurality of internal couplers define an elbow or corner coupler for coupling at least two of the plurality of beams together at a predetermined angle.

The structure wherein at least one of the plurality of internal couplers define a generally straight coupler for coupling at least two of the plurality of beams such that their respective axes are generally coaxial.

The beam wherein the plurality of spline grooves comprising a first spline groove situated on a first end wall of at least one support beam and a second spline groove situated on a side fascia wall of the at least one support beam.

The beam wherein the plurality of spline grooves are oriented catty-corner or diagonally with respect to each other.

The beam wherein the beam is integrally or monolithically formed.

The beam wherein the beam is a self-mating beam having a first mating half and a second mating half that are mated together and cooperate to define the beam, the first mating half having a roof screen spline groove and the second mating half having a wall screen spline groove.

The building system wherein the at least one fastener comprises a plurality of fasteners and the plurality of beam walls defines a plurality of fascia walls and a plurality of non-fascia or end walls, each of the plurality of fasteners comprising being mounted in one of the plurality of non-fascia or end walls and not any of the plurality of fascia walls.

These and other objects and advantages of the invention will be apparent from the following description, the accompanying drawings and the appended claims.

BRIEF DESCRIPTION OF THE ACCOMPANYING DRAWINGS

DETAILED DESCRIPTION OF THE PREFERRED EMBODIMENTS

Figure 1A:
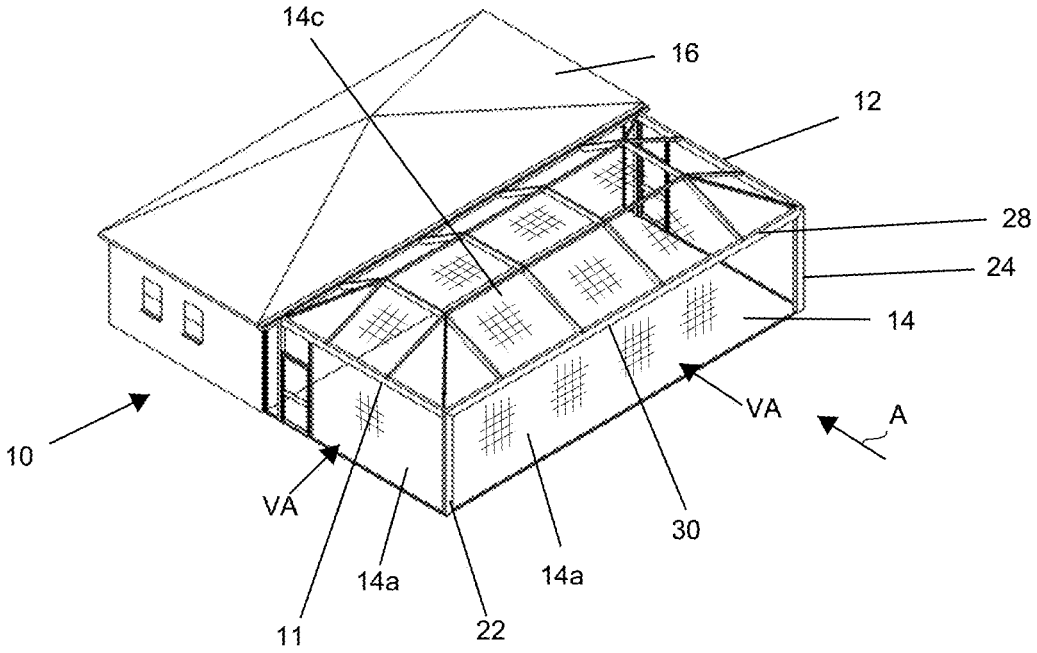
FIG. 1A is a perspective view illustrating one embodiment with all walls having a full or wide viewing aspect.
Figure 1B:
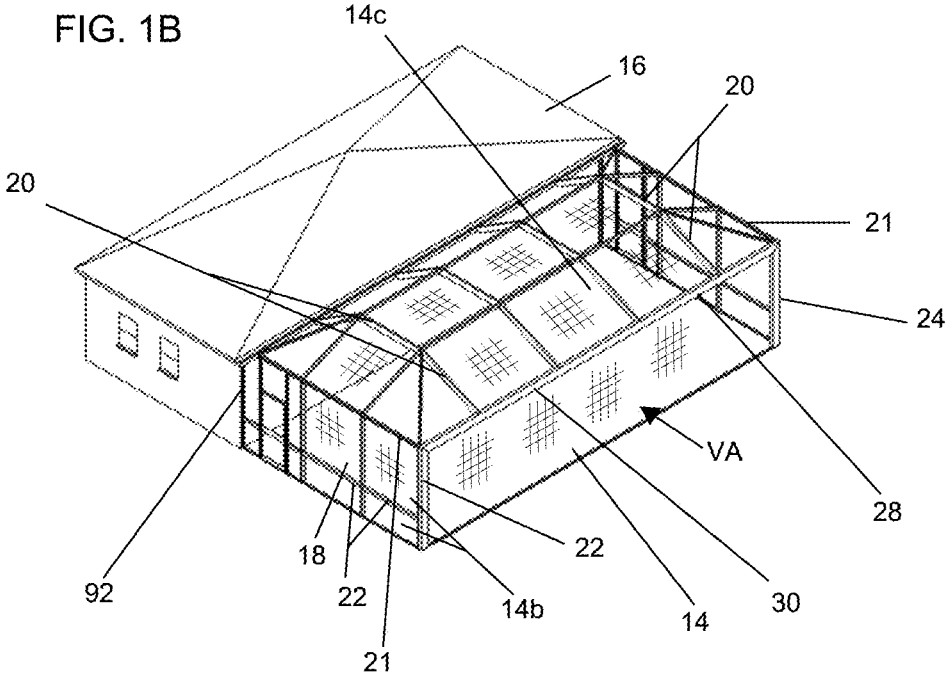
FIG. 1B is a view of another embodiment showing only one wall with a large or wide viewing aspect.
Figure 1C:
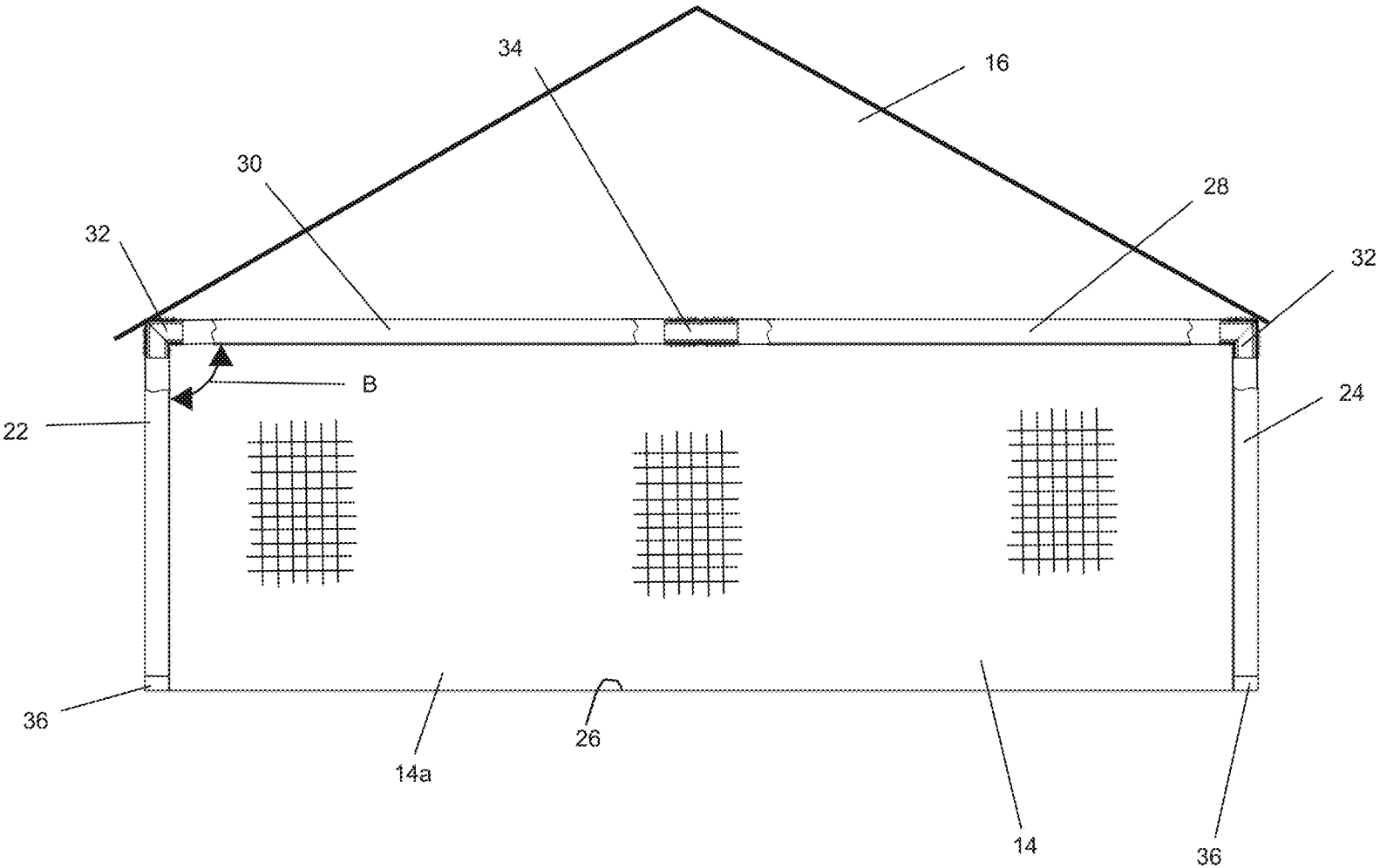
FIG. 1C is a partial fragmentary view showing a plurality of couplers used in constructing a frame.

Referring now to FIGS. 1A-12I, a system and method for constructing a structure 10 is shown. In the illustration being described, the structure 10 defines at least one of a lanai, screen enclosure, carport, walkway cover or other outdoor or indoor framed structure. In the illustration being described, the structure 10 is a lanai frame 12 that supports a mesh screen 14 of the type conventionally known. The structure 10 is a lanai that is attached to a building 16, such as a house, office or other structure, as illustrated in FIGS. 1A-1C. One significant advantage of the structure 10 is that it reduces or eliminates a number of vertical and horizontal beams that were traditionally required in the past so that it provides relatively large viewing areas VA that are unobstructed by beam structure. Of course, the structure 10 also requires fewer beams. Consequently, the structure 10 is less expensive than comparable wide view systems of the past. This is advantageous, for example, when people are located inside the lanai and viewing the environment outside of the lanai. For ease of illustration, the viewing area is labeled VA in FIGS. 1A and 1B.

The embodiments illustrated in FIGS. 1A and 1B illustrate the contrast between a screen wall that defines a large viewing area VA and one that does not. For example, FIG. 1A illustrates a screen wall 14*a* that defines a side of the lanai structure 10. Note that other than the primary horizontal support beam 11 and lateral support beam 22, there are no horizontal or vertical support beams or columns that are necessary to support the screen wall 14*a* in FIG. 1A. In contrast, note in FIG. 1B that a side wall 18 is defined by a plurality of screens 14*b* that are supported by a plurality of vertical and horizontal beams 20 and 21, respectively. Note the difference in FIGS. 1A and 1B, with the wall 18 in FIG. 1B being typical of the prior art. The embodiments described and claimed herein advantageously permit an entire wall to be formed and defined by the screen 14 while reducing or eliminating vertical or horizontal support beams of the past, thereby providing the large viewing area VA.

The structure 10 is typically mounted to a support structure, such as a concrete or cement slab and/or the building 16 to which it is attached. Details of the structure 10 and its various components will now be described.

For ease of illustration, FIG. 1C is a view taken in the direction of arrow A in FIG. 1A showing a plurality of vertical beams 22 and 24 that extend from a surface or support structure 26, such as a concrete slab, and that are coupled to at least one or a plurality of horizontal beams 28 and 30 as shown. In the illustration being described, the structure 10 comprises at least one or a plurality of beams, such as beams 11, 20, 21, 22, 24, 28 and 30. The structure 10 further comprises at least one or a plurality of internal couplers 32, 34 and 36 as shown in FIG. 1C. In the illustration being described, note that the at least one or a plurality of internal couplers 32, 34 and 36 are received inside the beam structures 22, 24, 28 and 30 as shown. For ease of illustration, the beams 22, 24, 28 and 30 shown in FIG. 1C are partially fragmented to show the at least one or a plurality of internal couplers 32, 34 and 36. It should be understood that the beams 11, 20, 21, 22, 24, 28 and 30 receive the at least one or a plurality of internal couplers 32, 34 and 36 and are fastened thereto. The at least one or a plurality of internal couplers 32, 34 and 36 are positioned inside the beams and not visible to the naked eye. In the illustration being described, the at least one coupler 32 is a corner coupler and couples two beams, such as beams 22 and 30, together such that they are oriented relative to each other at an angle B of approximately 90 degrees as illustrated in FIG. 1C. Details of the corner key or corner coupler 32 are illustrated in FIGS. 2A-2E, which will now be described. FIG. 2E is an enlarged view after the corner coupling 32 is mounted in the beams 24 and 28.

The at least one splicing coupler 34 is generally elongated and linear and couples two beams, such as beams 28 and 30, together as illustrated in FIG. 1C. Note, for example, the beams 28 and 30 are coupled together using a splice coupler 34 in accordance with one embodiment of the invention. Details of the at least one coupler 34 are illustrated in FIGS. 5A-5E. Finally, the at least one support coupler 36 supports or secures at least one beam to a support structure, such as the building 16 of the surface or support structure 26. FIG. 1C illustrates the at least one or a plurality of internal couplers 36 mounted to the surface or support structure 26 and the beams 22 and 24 mounted thereon. The details of the at least one coupler 36 are shown in FIGS. 6A-7E.

Figure 2A:
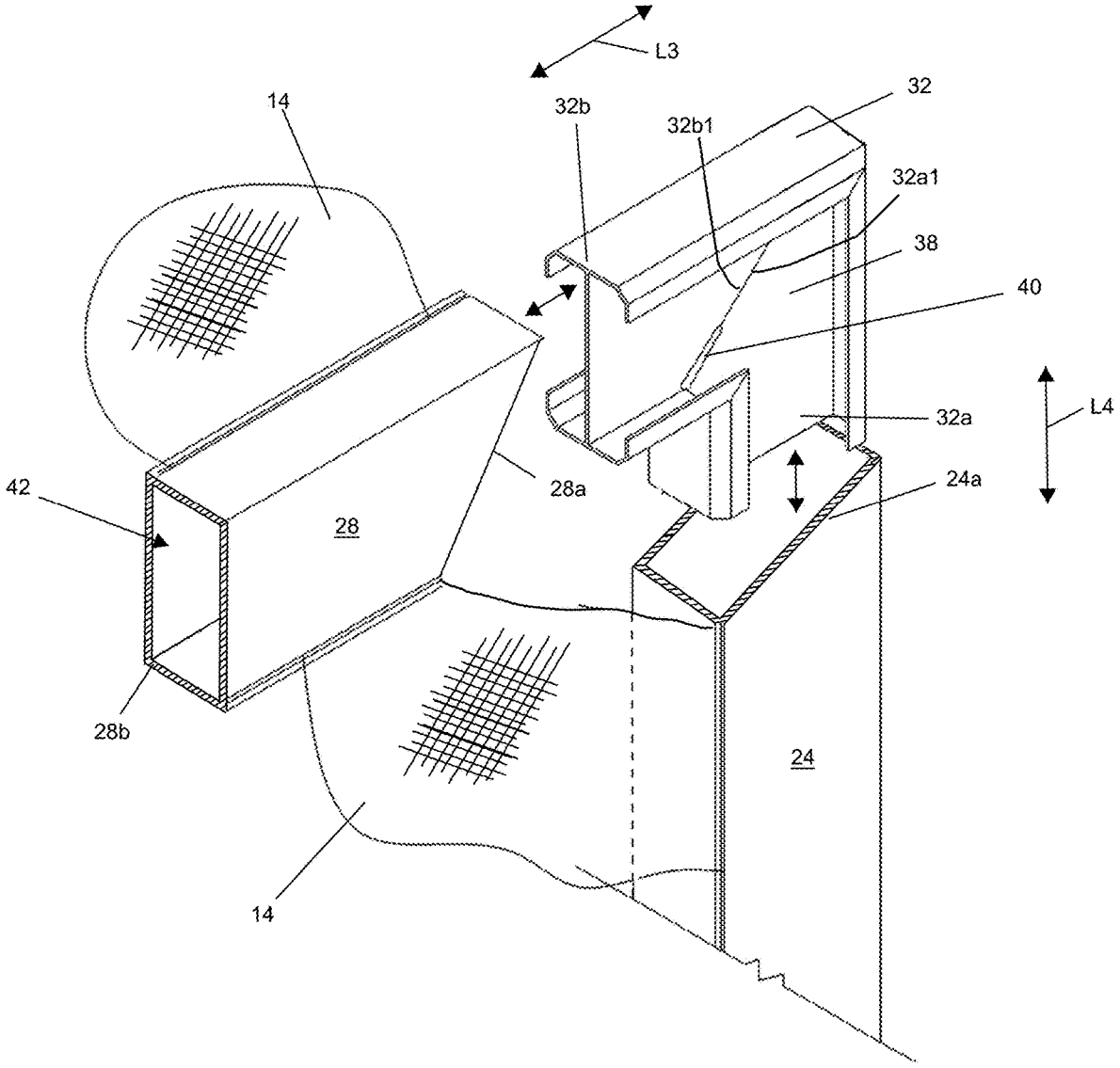
FIGS. 2A-2E are various fragmentary views illustrating at least one coupler in the form of a corner key or corner coupler.
Figure 2B:
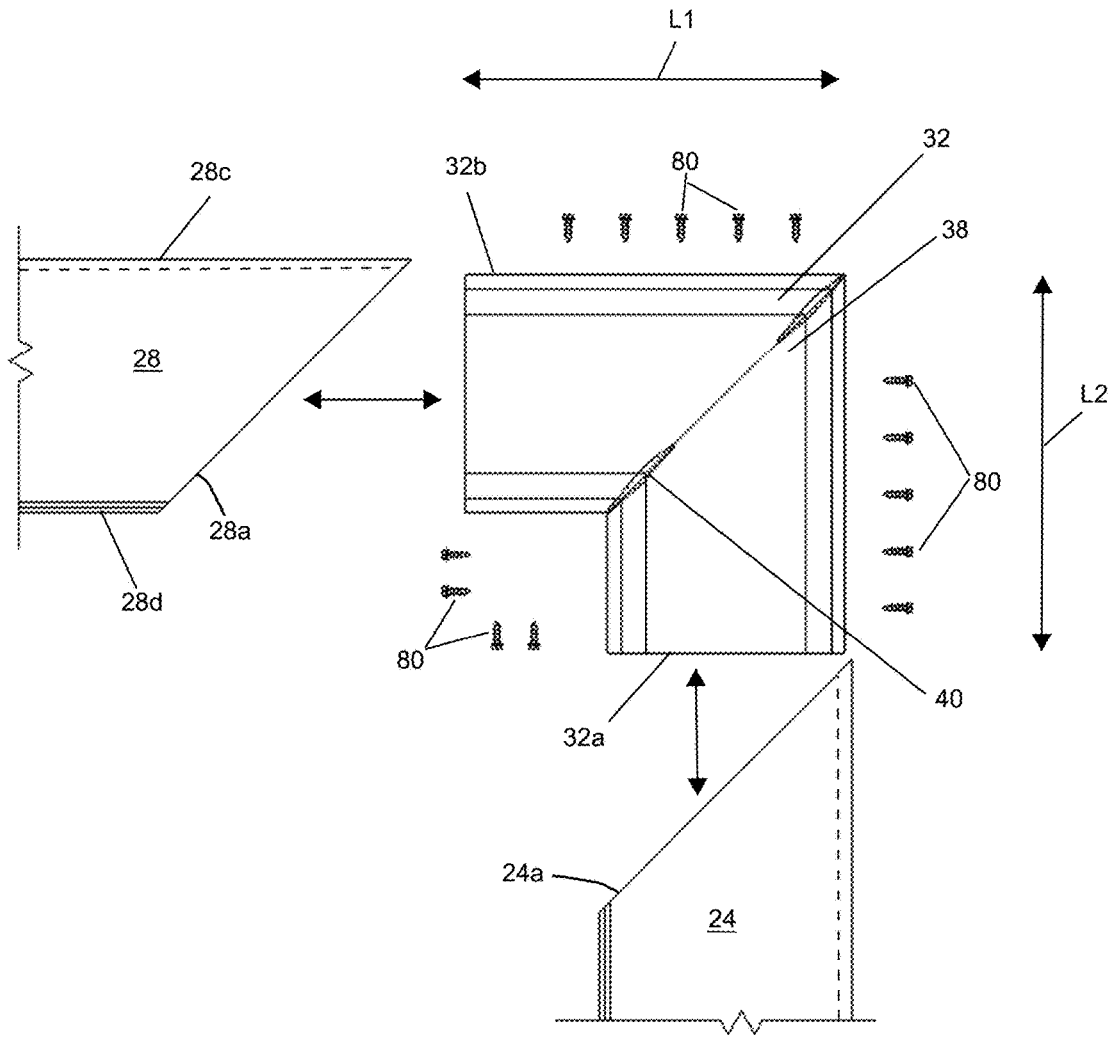
Figure 3:
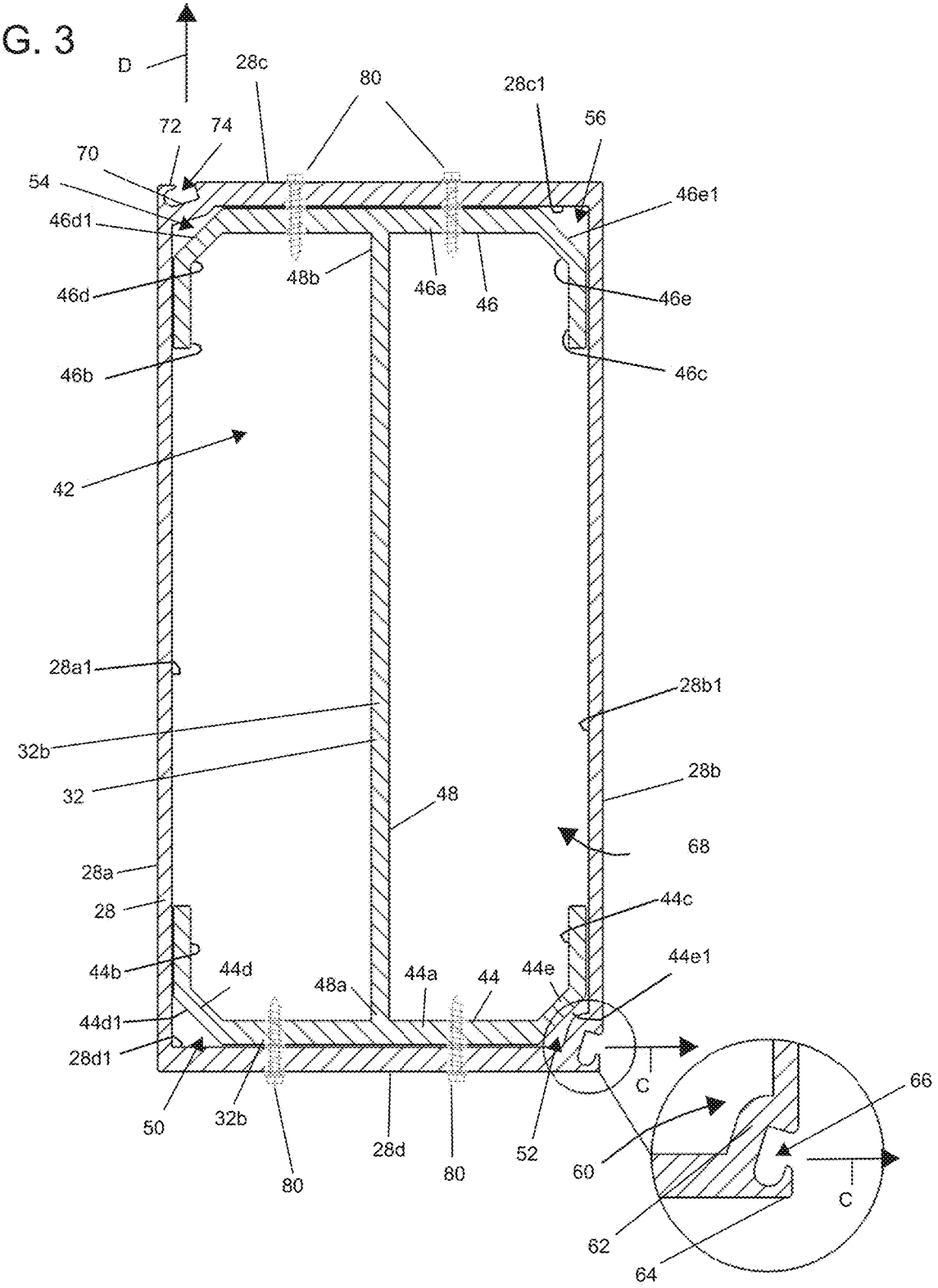
FIG. 3 is a sectional view taken along the line 3-3 in FIG. 2E.

Referring now to FIG. 2A, details of the at least one coupler 32 will now be described. In the illustration being described, the at least one coupler 32 comprises a body having a first portion 32*a* and a generally orthogonal second portion 32*b*, each of which generally comprises an I-beam or H-beam shape in cross-section (depending on viewing orientation) as illustrated in FIG. 3. Note that each of the embodiments of the at least one or a plurality of internal couplers 32, 34 and 36 comprises a similar cross-sectional configuration.

For ease of description, the shape, configuration and operation of the first portion 32*a* and second portion 32*b* will be described, with it being understood that the couplers 34 and 36 of the other embodiments described herein have the same or generally similar cross-sectional shape and operate and function in the same or generally similar manner as that which is now being described in FIGS. 2A-2E.

For ease of illustration, the at least one coupler 32 is shown in FIG. 2A, with it being understood that the at least one coupler 32 is a corner key or corner coupler that couples beams 24 and 28 together to form an elbow or corner. The at least one coupler 32 has the first portion 32*a* that is received in a beam end 24*a* of the vertical beam 24. Likewise, the at least one coupler 32 comprises the second portion 32*b* that is received in a beam end 28*a* of the horizontal beam 28. In the illustration being described, the coupler portions 32*a* and 32*b* are each generally in the shape of an I in cross-section and are received inside the beams 24 and 28. For ease of manufacturing, the at least one coupler 32 is comprised of the first portion 32*a* and the second portion 32*b* as illustrated in FIG. 2A. The portions 32*a* and 32*b* comprise ends 32*a*1 and 32*b*1 (FIG. 2A) that are miter cut at approximately 45 degrees and then brought together in a fixture (not shown) and fastened together, such as by at least one weld 40 (FIG. 2A), adhesive, screw, glue or other type of bond or fastener.

Referring back to FIGS. 2A-2E, it should be understood that the portions 32*a* and 32*b* are sized and adapted to be press-fit or fit snugly into the ends 24*a* and 28*a*, respectively. Notice in the sectional view in FIG. 3 that the coupler portion, such as coupler portion 32*b*, is adapted and sized to be inserted into a beam (beam 28 in the illustration). Preferably, the at least one coupler 32 is sized, shaped and adapted to be press-fit into the beams 24 and 28 or otherwise fit snugly therein. It has been found that the at least one or a plurality of internal couplers 32, 34 and 36 increase an overall strength of the spanning beam. The inventor has found that increasing the internal enforcement/reinforcement length allows for a greater transfer of load to the substrate or beam.

In the illustration being described, each of the beams 24 and 28 (FIG. 3) comprises a plurality of internal wall surfaces, some of which either contact or become juxtaposed next to at least a portion of the at least one coupler 32. For example, the beam 28 comprises a plurality of beam walls 28*a*, 28*b*, 28*c* and 28*d* (FIG. 3) having internal beam wall surfaces 28*a*1, 28*b*1, 28*c*1 and 28*d*1, respectively. These walls 28*a*-28*d* cooperate to define an aperture 42 into which the portion 32*b* may be situated. As mentioned earlier herein, the at least one coupler 32 is adapted and dimensioned to be received in the aperture 42 and comprises a plurality of coupling surfaces described herein that become positioned or juxtaposed in operative relationship with the plurality of internal wall surfaces 28*a*1-28*d*1 of the at least one support beam 28.

As best illustrated in FIGS. 2A and 3 and as mentioned earlier herein, note that each of the at least one or plurality of couplers 32, 34 and 36 have a cross-sectional shape that is generally in the form of an I or an H depending on one's viewing angle. The first and second portions 32*a* and 32*b* of the at least one coupler 32 cooperate to generally define an L-shape as shown in FIGS. 2A-2E and 9A-9H, and this predetermined configuration will now be described relative to FIG. 3.

As previously mentioned, each of the at least one or plurality of couplers 32, 34 and 36 have a generally common cross-sectional configuration, although they could be slightly different in size, dimension or shape depending on the beam into which they are received. For ease of description, the configuration, mounting, shape and operation of the at least one coupler 32 and beam 28 will be described. The second portion 32*b* comprises a first flange 44, a second flange 46 and a rib or web 48 that is monolithically formed with the first and second flanges 44 and 46 as shown in FIG. 3. Note that the flanges 44 and 46 are generally U-shaped (as viewed in FIG. 3) in cross-section, with their openings facing each other. In this regard, note that the first flange 44 is integral or monolithically formed in a first end 48*a* of the rib 48 and the second flange 46 is integral and monolithically formed with a second end 48*b* of the rib 48.

The flanges 44 and 46 have a first elongated portion 44*a* and 46*a*, respectively, which are generally parallel to each other and generally perpendicular to the rib 48. The flange 44 comprises a monolithic or integral first flange wall 44*b* and a second flange wall 44*c*, both of which are generally parallel to the rib 48 as shown. The flange walls 44*b* and 44*c* are integrally or monolithically formed and coupled to the flange elongated portion 44*a* by beveled or truncated wall portions 44*d* and 44*e*, respectively, as shown. The second flange 46 also comprises a third flange wall 46*b* and a fourth flange wall 46*c*, both of which are generally parallel to the rib 48. Note that the third and fourth flange walls 46*b* and 46*c* are also integrally or monolithically formed with the first elongated portion 46*a* by a truncated or beveled portion 46*d* and 46*e* as shown.

It is important to note that the beveled portion 44*d* comprises a surface 44*d*1 that cooperates with the interior surfaces 28*d*1 and 28*a*1 of the beam 28 to define an interior internal triangularly shaped aperture or channel 50. Likewise, the beveled portion 44*e* comprises a surface 44*e*1 that cooperates with the interior surfaces 28*d*1 and 28*b*1 to define an interior aperture or channel 52. The beveled portion 46*d* comprises a corner or surface 46*d*1 that cooperates with the interior surfaces 28*c*1 and 28*a*1 to define an interior aperture or channel 54. Finally, the beveled portion 46*e* comprises a surface 46*e*1 that cooperates with the interior surfaces 28*c*1 and 28*b*1 to define the interior generally rectangular shaped and elongated aperture or channel 56.

In the illustration being described, the channels 50-56 generally extend in the beam 28 the lengths L1 and L2 (FIG. 2B) of the portions 32*a* and 32*b*. Thus, the channels 50-56 for the corner coupler 32 extend a length L3 and L4 (FIG. 2A).

It is important to note that the truncated portions 44*d*, 44*e*, 46*d* and 46*e* all facilitate defining the interior channels 50-56, respectively, that have or define a predetermined shape. The channels 50-56 are adapted to accommodate an internal beam structure, such as an internal beam structure 60 (shown in the enlarged view in FIG. 3) of the at least one or plurality of support beams 22, 24, 28 and 30. In the illustration being described, the internal beam structure 60 (FIG. 3) may comprise a spline groove channel wall or projection 62 that cooperates with a flange 64 to define a first spline groove or channel 66 for receiving the screen 14 and a conventional spline (not shown) for retaining this screen 14 in the spline groove or channel 66. The spline groove or channel 66 opens in a direction of arrow C in FIG. 3. Note that the spline groove channel wall or projection 62 extends into and is accommodated by the interior aperture or channel 52 of the beam 28 as illustrated. The beam 28 has a second projecting portion 70 that cooperates with a flange 72 to define a second spline groove or channel 74. The portion 70 also extends into the area 68 as shown in FIG. 3 and into the aperture or channel 54 as illustrated in FIG. 3. It should be appreciated that the beam 28 in this example has only two spline grooves or channels 66 and 74 (FIGS. 3 and 4), but more or fewer spline grooves or channels could be provided. It should be understood that in the prior art, the beams typically had a spline groove used for either a roof screen or wall screen, but not both. In fact, it was not uncommon that a second beam structure, such as a 1"×2" beam having a spline groove had to be mounted to a primary beam to provide a spline groove for the wall screen.

Figure 4:
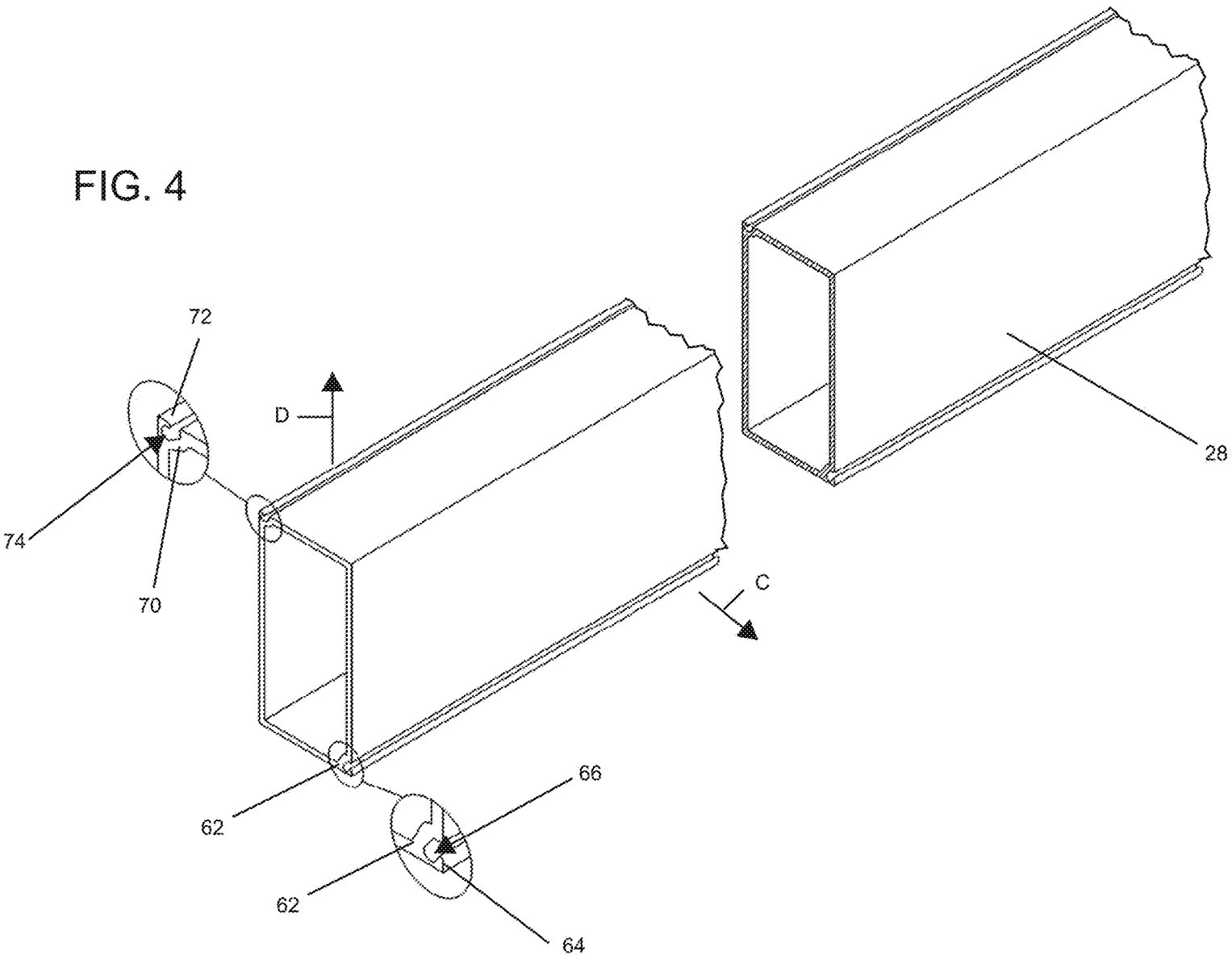
FIG. 4 is a fragmentary view of a support beam in accordance with one embodiment showing exploded views of the spline grooves and their respective facing directions.

Advantageously, the at least one corner coupler 32 is adapted, shaped and sized to accommodate the internal beam structure 60 and it has been found that the beveled corners facilitate inserting the at least one corner coupler 32 into the beams 24 and 28. It is significant to note that the spline groove or channel 66, for example, is located on the wall 28*b* and faces outward from the fascia wall surface 28*b*2 in the direction of arrow C as illustrated in FIG. 3. In contrast, the spline groove or channel 74 is located catty-corner or generally diagonally to the spline groove or channel 66 and opens in a direction facing arrow D (FIG. 3), which is generally orthogonal to the direction C of channel 66. This different orientation of spline grooves or channels 66 and 74 enables the beam 28 to accommodate the vertical wall screens 14*b* (FIG. 1A) and the angled or horizontal ceiling screen 14*c*. The embodiments shown and described herein provide the beam 28 that has spline grooves 66 and 74 for the wall and roof screen, without the need of additional beam or extrusion structures FIG. 4 shows a typical beam 28 in the illustration being described. In the illustration, the beam 28 is 4"×8" and of varying lengths. The plurality of internal couplers 32, 34 and 36 and the beam 28, as well as the other beams shown and described herein, are made of aluminum. Likewise, the at least one or a plurality of internal couplers 32, 34 and 36 are generally integral or monolithically formed or manufactured and are made of aluminum, but could be made of other material, such as steel, metal alloys or any other suitable metal.

Advantageously, the at least one or a plurality of internal couplers 32, 34 and 36 are adapted, sized and shaped to accommodate the internal beam structure 60 of the beam being used. While the embodiment being shown shows that each of the flanges 44 and 46 have multiple truncated corners, it should be appreciated that each flange 44 and 46 may be provided with only one truncated corner, depending on the beam 28 being used. If the beam 28 has other internal beam structures that need to be accommodated, then the corners of the flanges 44 and 46 or other portions of the coupler 32 may be truncated, recessed or indented so that accommodating apertures or channels can be provided.

Figure 2C:
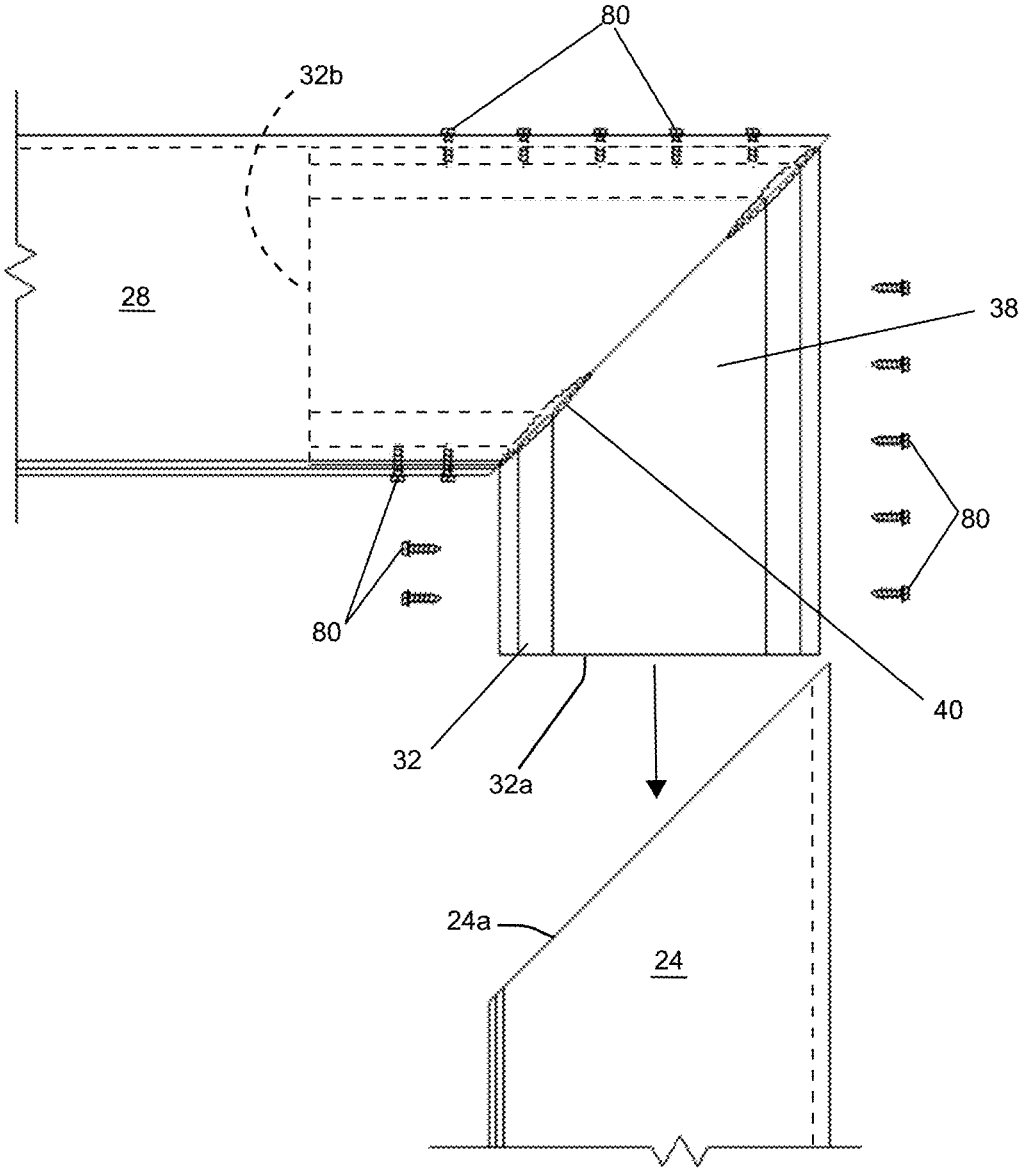
Figure 2D:
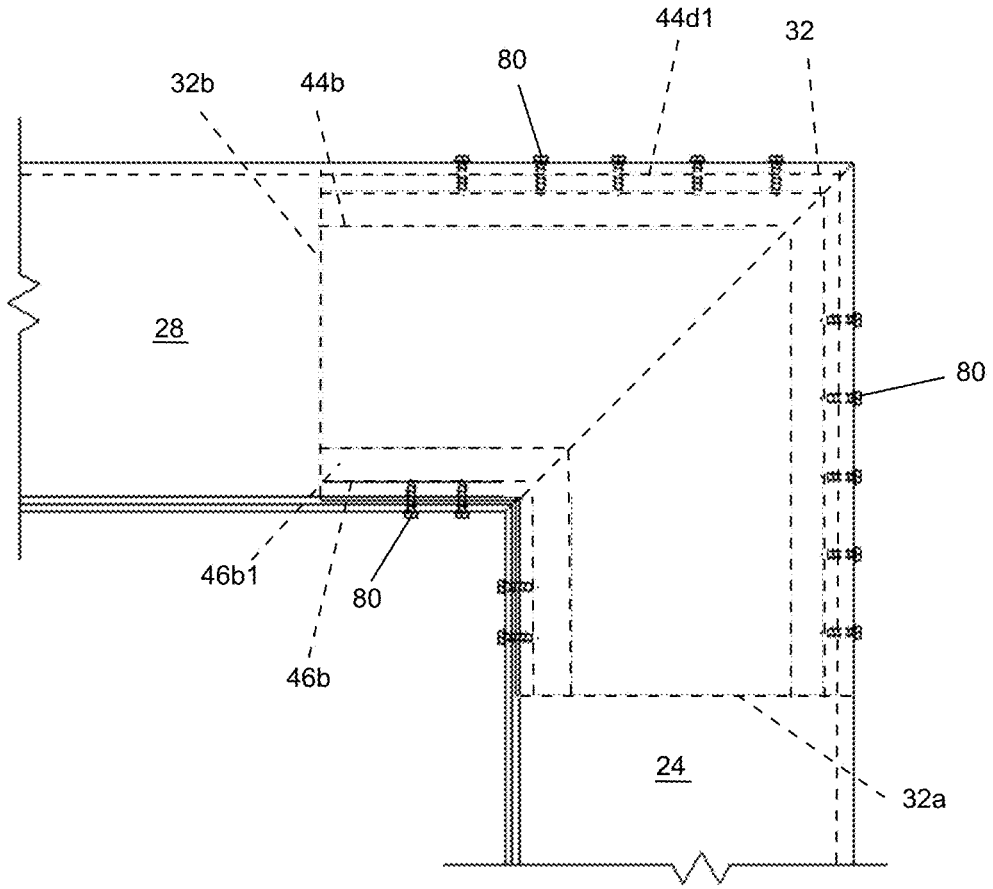
Figure 2E:
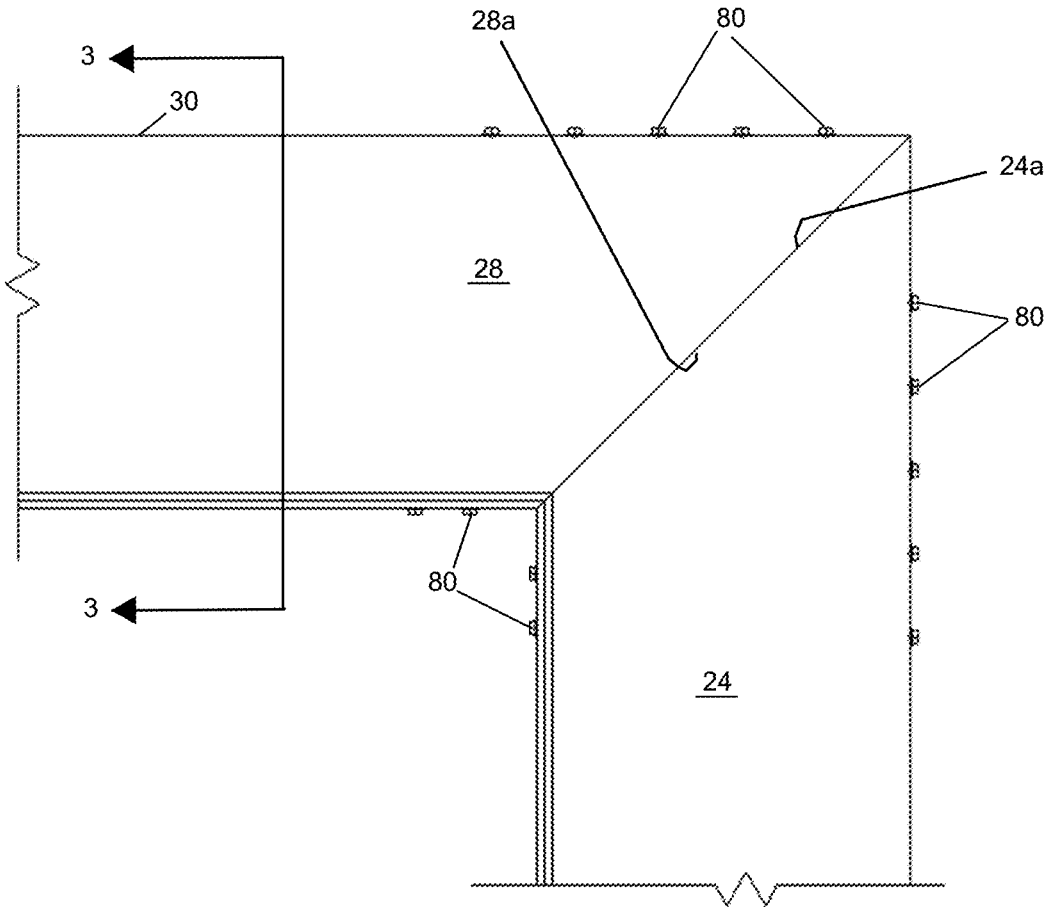

FIGS. 2B-2E illustrate the assembly of the structure using the corner key coupler 32. In the illustration being described, note that the beams 24 and 28 have the mitered or angled ends 24*a* and 28*a* that receive the first portion 32*a* and the second portion 32*b*, respectively. The second portion 32*b* of the coupler 32 is guided into and received in the end 28*a* of the beam 28 and the first portion 32*a* of the coupler 32 is guided into and received in the end 24*a* of the beam 24, as illustrated in FIGS. 2C and 2D, respectively. As illustrated in FIG. 2C, after the second portion 32*b* is received in the beam 28, the screws or fasteners 80 are used to fasten the beam 28 to the coupler 32 as shown. Likewise, after the first portion 32*a* is received in the beam 24, the screws or fasteners 80 are used to secure the beam 24 to the first portion 32*a* as illustrated in FIG. 2D. Once these parts are assembled, the vertical beam 24 is coupled to the beam 28, and they form generally a ninety degree (90°) angle to define a corner of the structure 10.

It is important to note the positioning of the screws or fasteners 80, which is a unique feature of the embodiments. In this regard, note that beam 28 has the generally opposing end walls 28*c* and 28*d* (FIG. 3) that are typically oriented as illustrated in FIG. 3 and fascia walls 28*a* and 28*b* that are relatively longer and define side walls or fascia of the beam 28. Note that none of the screws or fasteners 80 are screwed into the fascia walls 28*a* and 28*b* when coupling the corner coupler 32 to the beam 28. As best illustrated in FIGS. 2A-2E, after the corner coupler 32 is received in the ends 24*a* and 28*a* of the beams 24 and 28, respectively, the screws or fasteners 80 are used to secure the beams 24 and 28 to the corner coupler 32. Note also that the screws or fasteners 80 extend through one of the beam walls 28*c* and 28*d*. In this regard, note that the screws or fasteners 80 only extend through one of the end walls, such as wall 28*c* or wall 28*d* of beam 28, and into the flanges 44 and 46 (FIG. 3) as shown. Likewise, beam 24 is similarly secured with the screws or fasteners 80 to the first portion 32*a* of the coupler 32.

In contrast, it was not uncommon in the prior art that through-bolts were mounted completely through the fascia or side faces, such as ends or fascia walls 28*a* and 28*b* of beam 28, which is aesthetically unpleasing.

Advantageously, the embodiment being described eliminates or reduces the need for such through-bolts and fascia fasteners.

After the screws or fasteners 80 have secured the beams 24 and 28 to the corner key or corner coupler 32, as illustrated in FIGS. 2D and 2E, note that the joint between the beams 24 and 28 increases the overall strength and support of the structure 10 and increases the lateral support. Advantageously, the embodiment being described may reduce or eliminate the need for traditional tie-down cables in view of the increased strength and resilience of the improved coupling between the beams 24 and 28.

It is important to note that the couplers 32, 34 and 36 and, for example, the first and second portions 32*a* and 32*b*, are sized and adapted depending upon a plurality of factors, including the desired overall span length, such as an overall desired length of beams 28 and 30. In this regard, note that the first portion 32*a* and second portion 32*b* of the corner coupler 32 have the lengths L1 and L2, respectively, that are generally the same in the illustration being described. It should be understood, however, that these lengths L1 and L2 could be different. In general, the couplers 32, 34 and 36 are dimensioned and sized based upon engineering requirements for the building or structure 16. The coupler 34 has a length L5 (FIG. 5A) and the coupler 36 has a length L6 (FIG. 6A). These lengths are selected depending upon several factors, such as an overall span length, such as beams 28 and 30, beam dimensions, and, for example, distance from the building 16. One predominate factor is the overall span length of the beams 28 and 30. In general, the portions 32*a* and 32*b* may be increased or decreased in response to a longer or shorter, respectively, span length. Again, various factors influence the size, length and/or shape of the couplers 32, 34 and 36 based on design load, distance from the building 16, height and length of the structure 10 walls.

After the beams 28 and 30 are coupled together, the coupler 32 is not visible to the naked eye as illustrated in FIG. 2E. Note also that the fascia or sides, such as side wall or fascia wall 28*a* and side wall or fascia wall 28*b* (FIG. 3), do not have any visible screws or fasteners 80, which is more aesthetically pleasing compared to prior art assemblies.

Figure 5A:
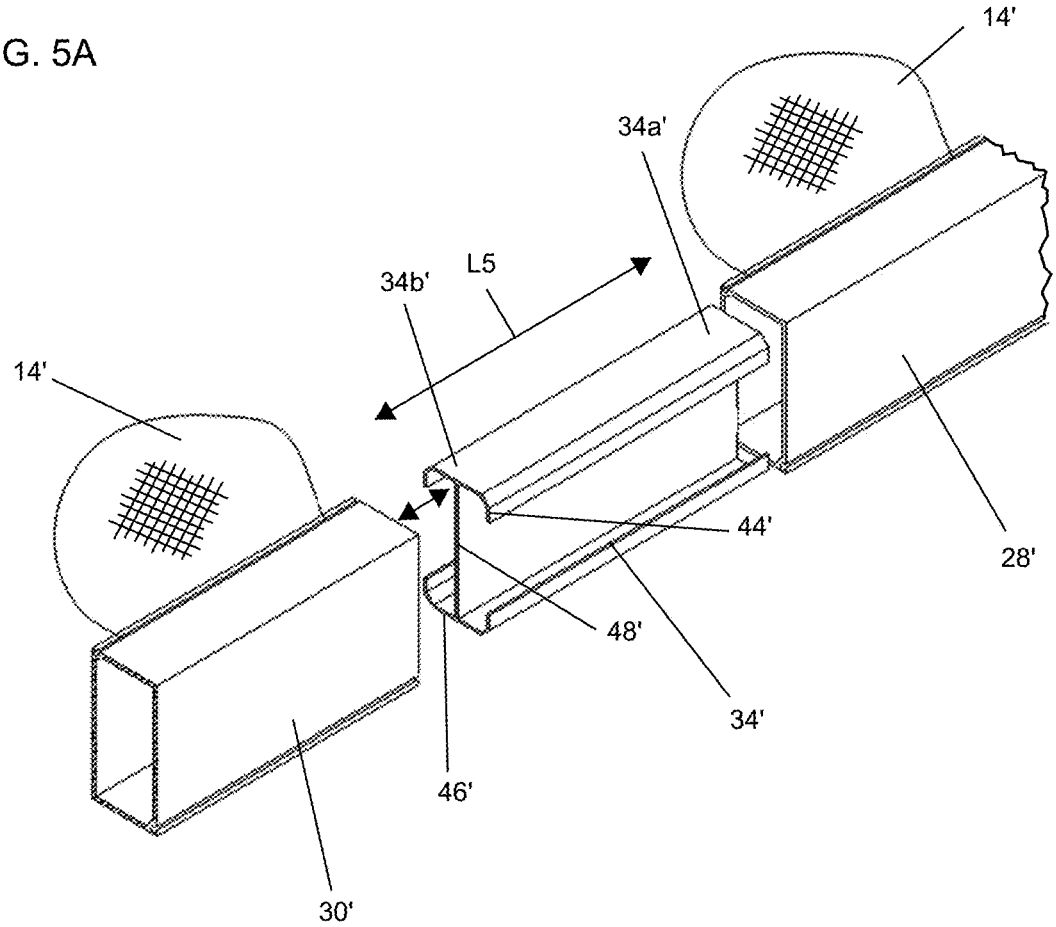
FIGS. 5A-5E are various fragmentary views showing at least one coupler in the form of a splicing coupler for splicing multiple beams together.
Figure 5B:
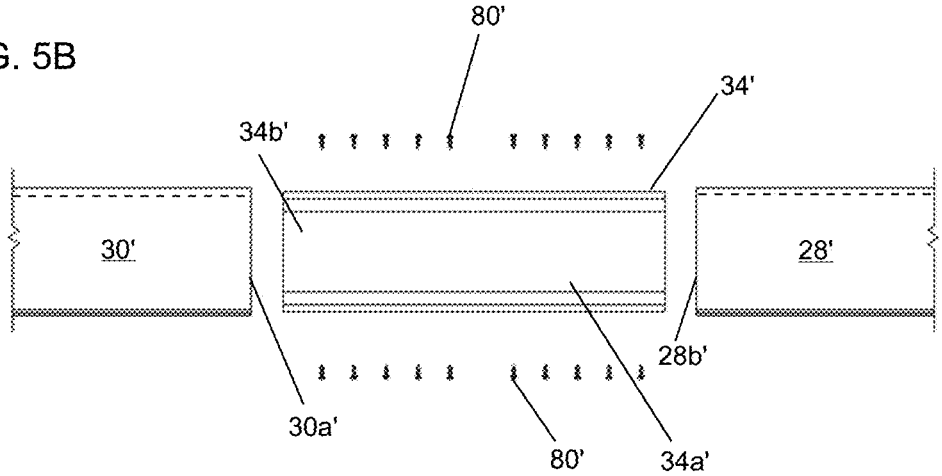

Referring now to FIG. 5A, the elongated splicing coupler 34' is shown. Like parts for this embodiment and for the embodiment showing the coupler 36' are identified with the same part numbers, except a prime mark ("") for the splicing coupler 34' embodiment and 36' for the coupler 36' embodiment have been added. As illustrated in FIGS. 5A-5E, note that generally equal portions 34*a*' and 34*b*' of the elongated coupler 34' are received in the beams 28' and 30', respectively, and the screws or fasteners 80' (FIGS. 5B-5E) are used to secure them together as illustrated. The coupler 34' in the illustration being described has the same or substantially similar generally I or H shape and cross-sectional configuration as the cross-sectional first and second portions 32*a* and 32*b* of the coupler 32.

The coupler 34' is adapted and sized to be received in the beams 28' and 30' and splice them as illustrated in FIGS. 2C and 5A-5E. Once generally equal parts of the coupler 34' are received in the beams 28' and 30', the screws or fasteners 80' secure the beams 28' and 30' to the coupler 34' in a manner similar to the corner key coupler 32 described earlier herein. As mentioned, the coupler 34' has a general I or H shape depending on orientation as with the prior embodiments and has generally U-shaped flanges 44' and 46', with beveled corners or surfaces 44*d*1', 44*e*1', 46*d*1' and 46*e*1', as with the embodiment described relative to the corner key coupler 32'. Again, a length L5 (FIG. 5A) of the coupler 34' is directly related to a desired overall span length of the beams 28' and 30' when they are coupled together. In other words, the length L5 is increased for greater desired span lengths and decreased for lesser span lengths, depending on the building structure 10' or the overall desired span length of the joined beams 28' and 30'.

It should be understood that while the embodiment illustrated shows only one coupler 34' coupling the beams 28' and 30', multiple couplers 34' could be used in an overall span. Shorter couplers 34' are required for shorter lengths, whereas longer couplers 34' or multiple couplers 34' may be required for longer lengths. Again, the overall length and size of the coupler 34' is selected depending upon the size and dimensions of the beams 28' and 30' and overall span length desired and the size of the structure 10' being built.

Figure 5C:
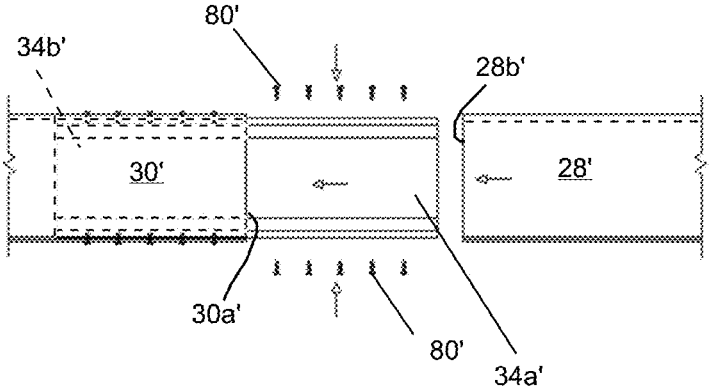
Figure 5D:
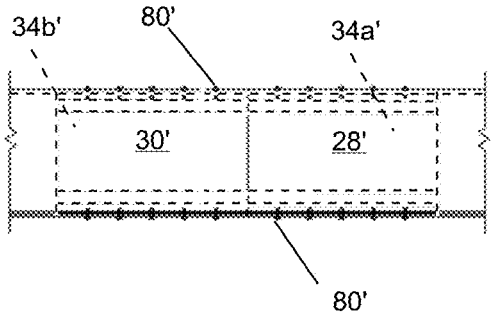
Figure 5E:
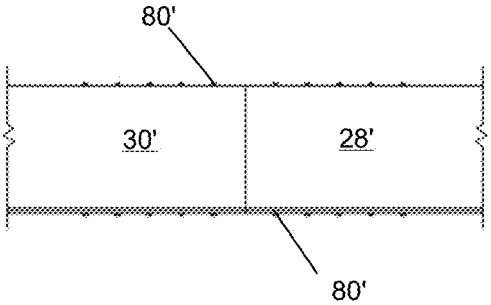
Figure 6A:
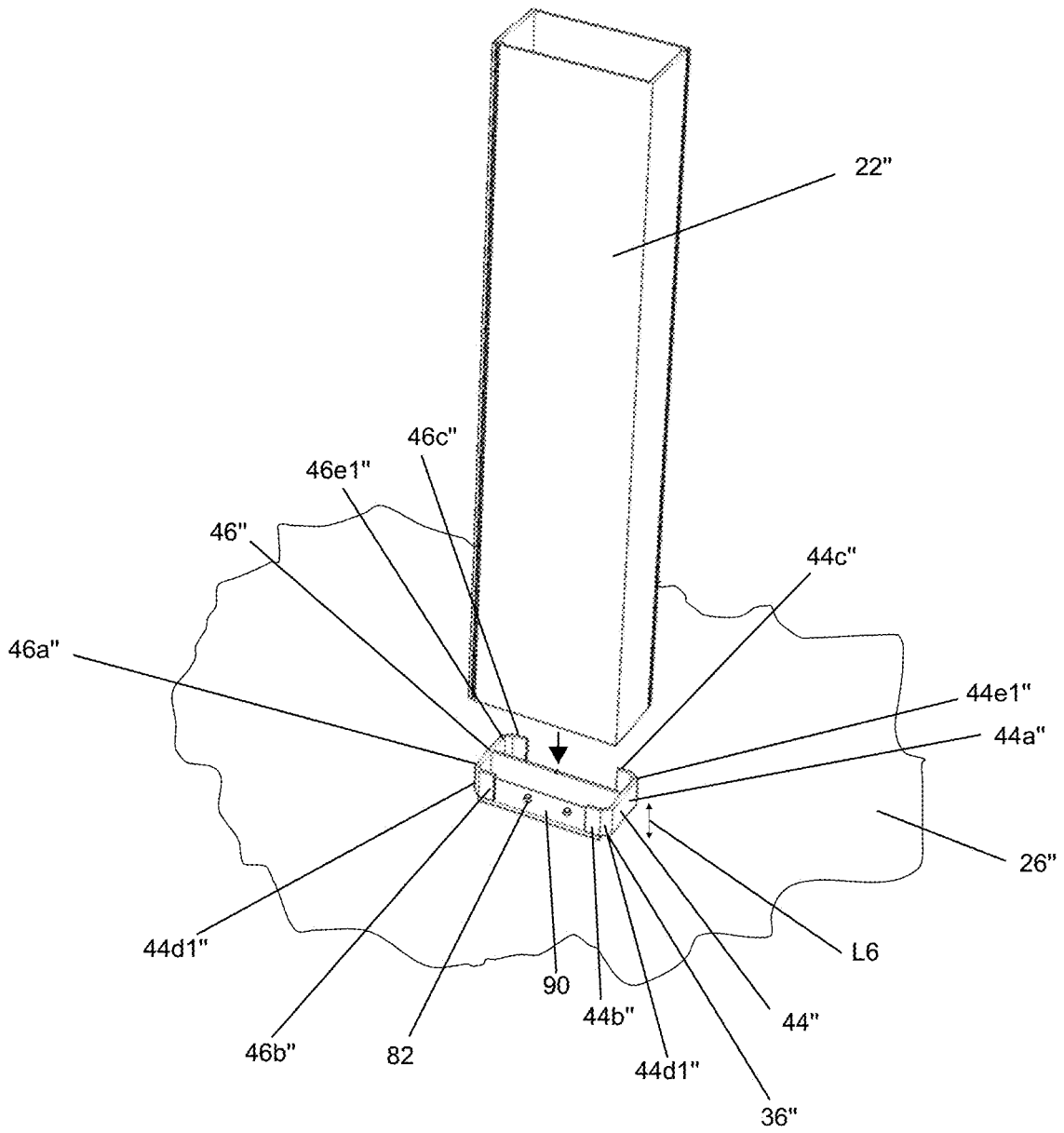
FIGS. 6A-6E are various fragmentary views of another embodiment showing at least one coupler in the form of a support coupler for coupling at least one beam to a support structure.

The coupler 34' comprises the first portion 34*a*' (FIGS. 5B-5E) and the second portion 34*b* mentioned earlier that are received in the ends 28*b*' and 30*a*' of the beams 28' and 30', respectively. The components and parts 28', 30' and 34' are moved relative to each other such that the portion 34*b*' is received in the end 30*a*' of the beam 30' and the portion 34*a*' is received in the end 28*b*' of the beam 28' as illustrated in FIGS. 5C and 5D. Once an end, such as end 28*b*' or end 30*a*', has been received on the first and second portions 34*a* and 34*b*, respectively, the screws or fasteners 80' are used to secure the beams 28' and 30' to the coupler 34' as shown. As with the previous embodiment being described relative to the corner key coupler 32, note in FIG. 5E that the coupler 34' is not visible to the naked eye once the beams 28' and 30' are received on the coupler 34' and the screws or fasteners 80' secured thereto.

The intermediate or splicing coupler 34' enables the coupling of beams 28' and 30' to provide an overall elongated beam which is beneficial for providing longer spans and increased large viewing aspect. In the illustration being described, the beams 28' and 30', once spliced together, can span a predetermined length selected by the user. In the illustration, the length is typically less than 50 feet. Note that in the prior art, beams of this length could only be achieved by increasing an overall size or dimension of the beam. For example, the wall thickness of the prior art beams was increased, which also typically increased the overall cost of the beam and structure.

Advantageously, the embodiments described herein can be used with beams, such as beams 28 and 30, that have reduced wall thicknesses compared to that of the prior art. It should be understood that the couplers 32, 34 and 36 could also be used with a split beam, such as the split beam shown or having the features of the beams shown in U.S. Pat. No. 7,877,962; U.S. Design Pat. Nos. D620,618; D620,619; D636,095; D666,743; D713,054 and D791,342, all of which are incorporated herein by reference and made a part hereof.

Figure 6B:
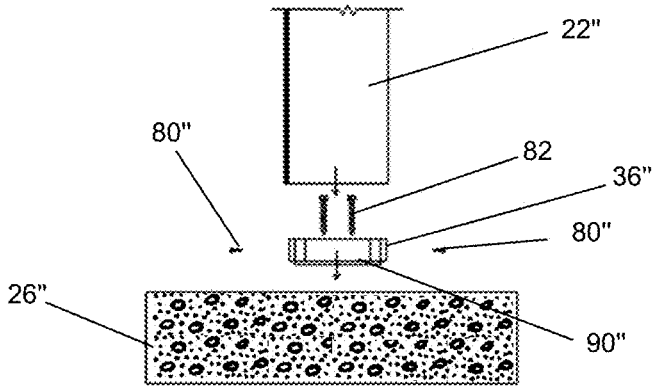
Figure 6C:
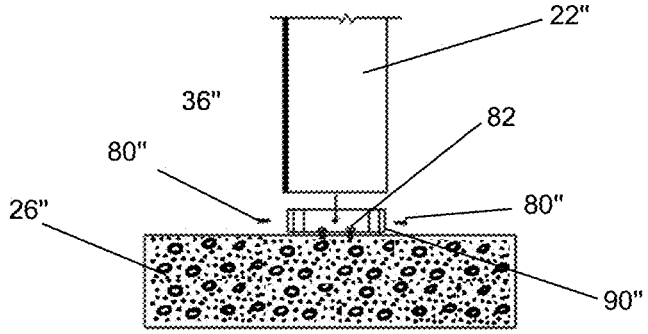
Figure 6D:
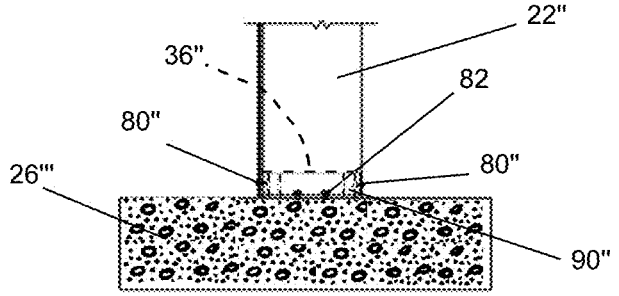

Another embodiment illustrates a support coupler 36" (FIGS. 6A-6E) that has a cross-sectional shape that is similar to the shape of the cross-sectional shape of the couplers 32 and 34. In this embodiment, like parts are identified with the same part numbers as in prior embodiments and operate in substantially the same manner except that a double prime mark ("") has been added to the like part numbers for this embodiment. The coupler 36" has a similar I-beam or H-beam shape in cross-section as in prior embodiments and further comprises an end plate or wall 90 that is situated on and fastened to a support, such as the surface or support structure 26" of a concrete slab, patio deck, beam, building wall or other support surface onto which the coupler 36" may be mounted using screws or fasteners 82, as illustrated in FIGS. 6B-6D. Note that a vertical or horizontal beam, such as beam 22, is received and mounted on the coupler 36" in a manner similar to the prior embodiments using the screws or fasteners 80" as shown. In this illustration, the coupler 36" has a length L6 (FIG. 6A) that is substantially shorter than the lengths L1-L5 of the prior embodiments. It should be understood, however, that each of the lengths L1-L6 could be longer or shorter and are selected in response to the beam size and dimension and the overall structural support needed.

Figure 6E:
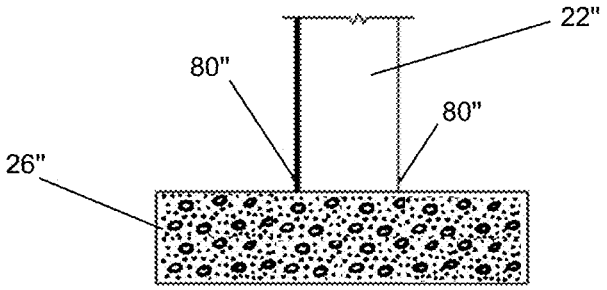

As with the prior embodiments, once the beam, such as beam 22", is mounted to the surface or support structure 26" with fasteners 82 (FIGS. 6A-6D). The fasteners 80" are used to secure the beam 22" to the coupler 36" as illustrated in FIGS. 6A-6E. As shown in FIG. 6E, the coupler 36" itself is not visible to the naked eye.

As mentioned earlier, the coupler 36" has a cross-sectional shape that is generally the same or similar to the cross-sectional shapes of the couplers 32 and 34 and functions and operates similarly as described earlier herein relative to FIGS. 1-5E. One advantageous feature of the coupler 36" is that it is adapted to be secured to any suitable support surface. In the illustrations being described in FIGS. 6A-6E, the surface or support structure 26" could be a patio deck, cement slab, building wall or other structure associated with building 16. In the example in FIGS. 6A-6E, the beam 22" is mounted on the coupler 36" and is generally vertical.

Figure 6F:
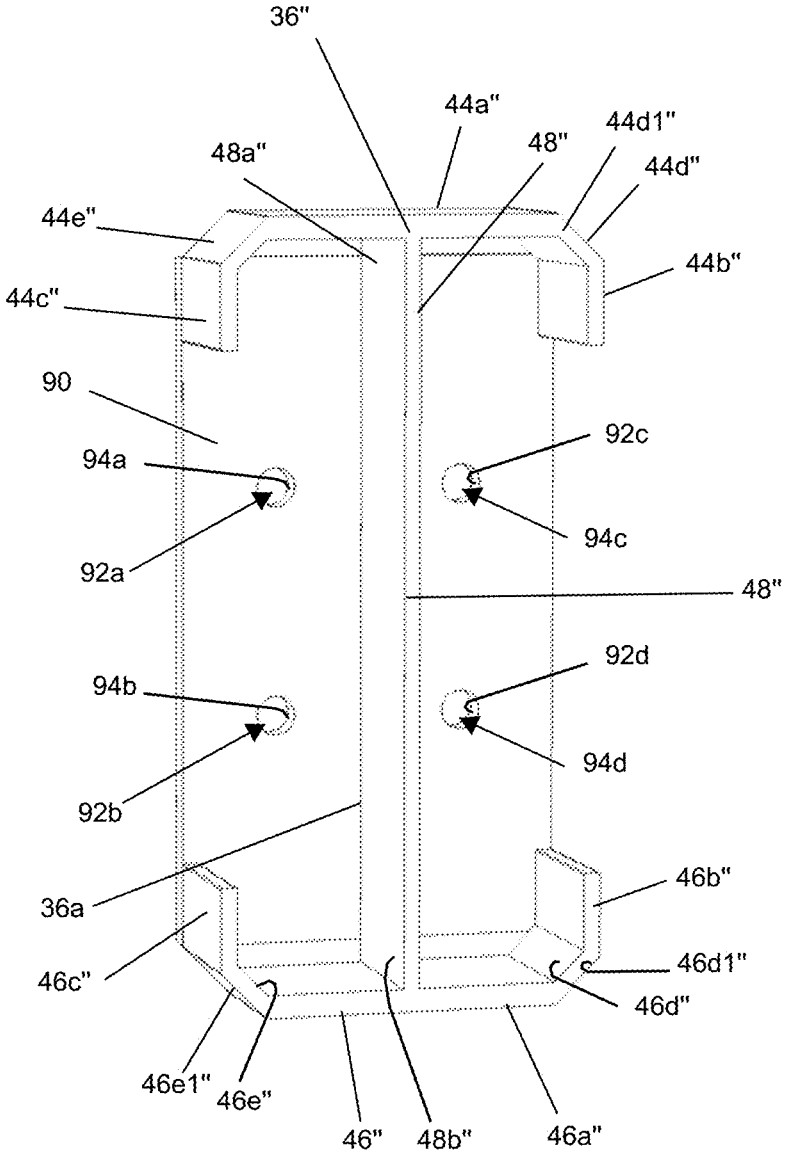
FIG. 6F is an enlarged view of the coupler illustrating a plate or wall having a plurality of internal aperture walls that define a plurality of apertures for receiving fasteners.

FIG. 6F is an enlarged view of the coupler 36" that shows the plate or wall 90 that has a plurality of internal aperture walls 92*a*-92*d* that define a plurality of apertures 94*a*-94*d*, respectively, for receiving the fasteners 82. The coupler 36" (FIG. 6F) comprises the flanges 44*a*" and 46*a*" and the rib 48". The flanges 44*a*" and 46*a*" and rib 48" operate and have generally the same shape, configuration and structure as the flanges 44*a* and 46*a* and rib 48 in the embodiment shown in FIG. 3 relative to the coupler 32. What is unique about the coupler 36" is that it has the plate or wall 90 integrally or monolithically formed or fastened to an end 36*a* by, for example, a weld or adhesive. The plurality of internal aperture walls 92*a*-92*d* that define a plurality of apertures 94*a*-94*d*, respectively, for receiving the fasteners 82 for securing or mounting the coupler 36" to the support surface or structure.

Figure 7A:
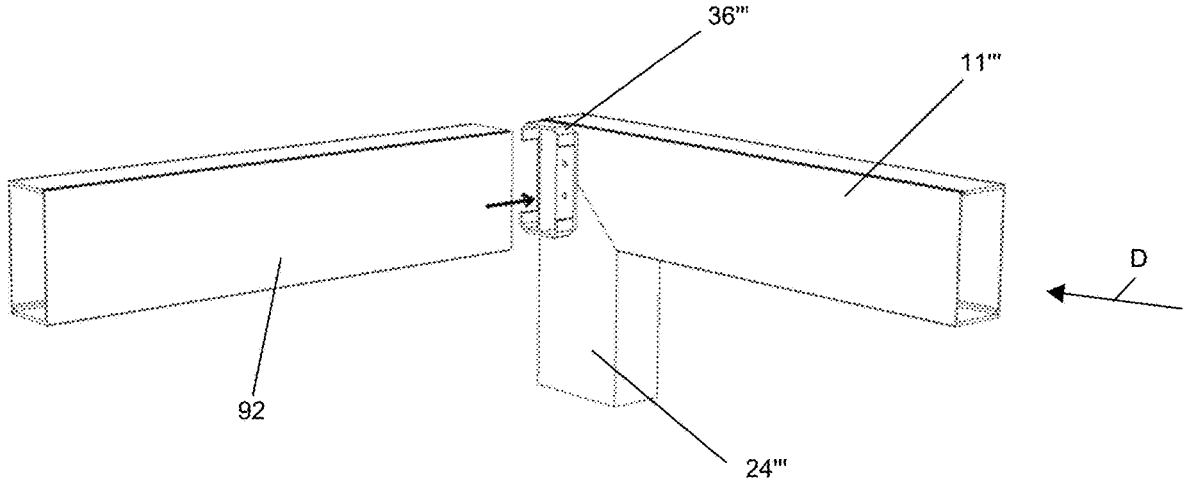
FIGS. 7A-7E are views of another embodiment showing the at least one support coupler for securing at least one beam to another beam.
Figure 7B:
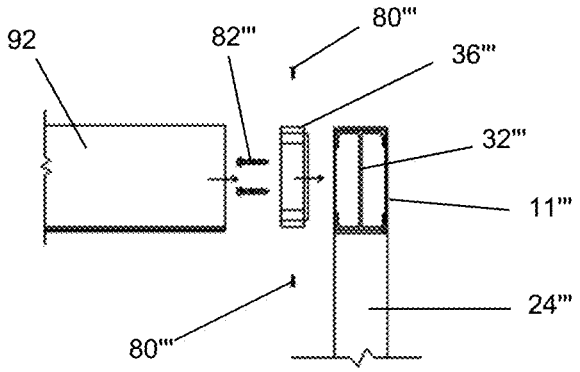
Figure 7C:
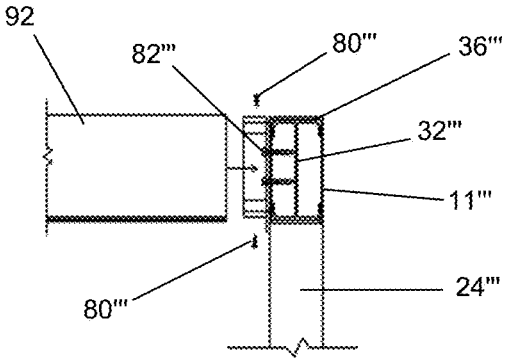
Figure 7D:
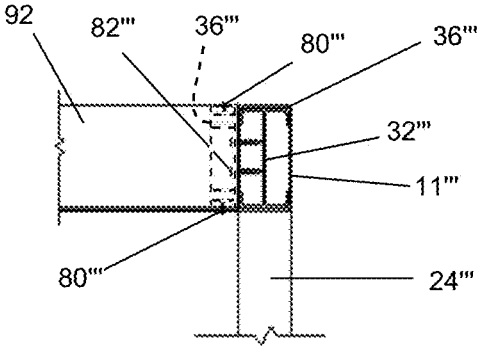
Figure 7E:
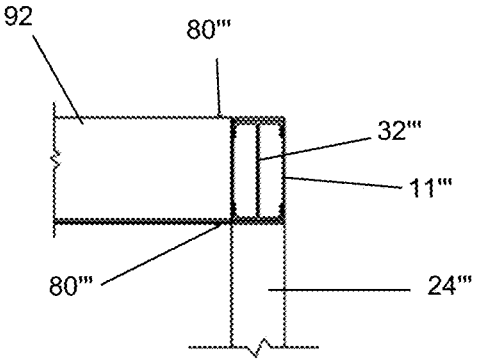

FIGS. 7A-7E show another embodiment wherein the coupler 36''' is mounted directly to another beam, such as one of the joined beams 24''' and 11''' as illustrated in FIG. 7A. Again, like parts are identified with the same part numbers as in prior art embodiments and operate in substantially the same manner except that a triple prime mark ("''') has been added to the part numbers of the like parts in this embodiment. Another beam, such as beam 92 (FIG. 7A), may then be mounted on the coupler 36''' using the fasteners 80''', thereby securing the beams 24''', 11''' and 92 together as illustrated in FIGS. 7A-7E. In the example, the beams 28''' and 92 are generally horizontal. FIGS. 7B-7E show views taken in the direction of arrow D in FIG. 7A illustrating the corner key coupler 32''' and the coupler 36''' joining beams 24''' and 11''' as shown. Once the coupler 36''' is mounted on the beams 24''' and 11''' using fasteners 80, the beam 92 may be mounted on the coupler 36''' as illustrated in FIGS. 7B-7E and the screws or fasteners 80''' are used to secure the beam 92 to the beams 24''' and 11''' as shown.

Figure 8:
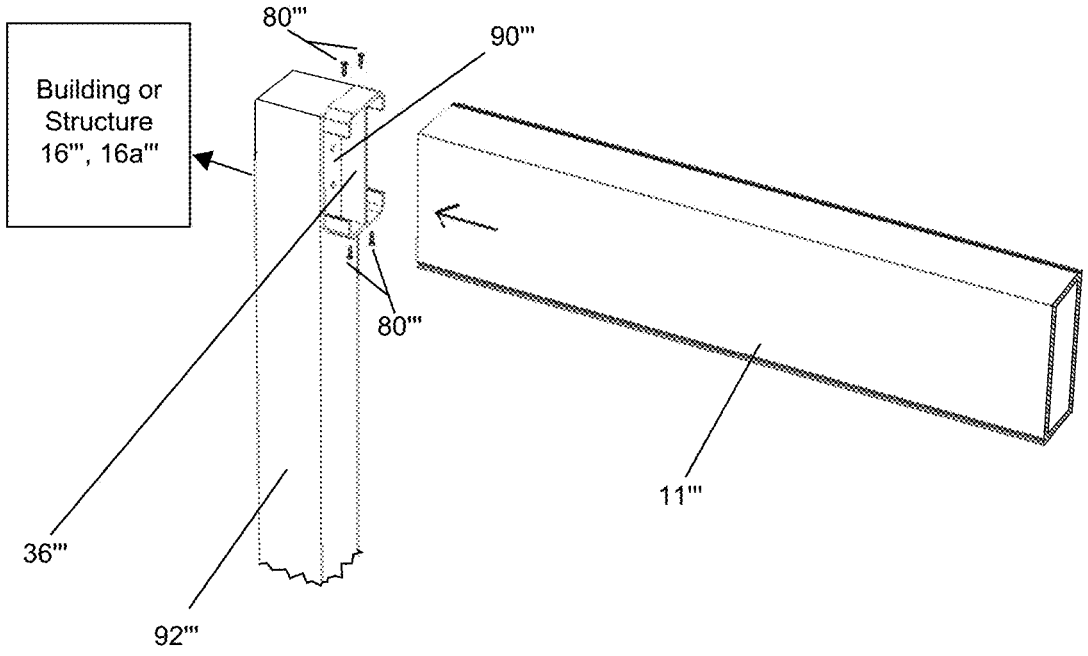
FIG. 8 is a view of another embodiment showing the at least one support coupler for coupling a beam to another beam or structure.

FIG. 8 illustrates another application of the coupler 36'''. In this embodiment, the coupler 36''' is mounted directly to a gutter 16*a*''' or surface of the building structure 16''' as shown. In this embodiment, the beam 11''' is mounted to the coupler 36''' which in turn is mounted to the gutter 16*a*''' or other structure of the building 16''' and supports the beam 11''' in a generally horizontal plane. In the embodiment illustrated in FIGS. 7A-7E, the beam 92 is generally horizontal and generally orthogonal to the beam 11''' to which it is attached. In contrast, the embodiment illustrated in FIGS. 6A-6E, the beam 92 lies in a generally vertical plane and provides a generally vertical support beam or column.

It should be understood that during construction of the structure 10 in one embodiment, the vertical beams 22 and 24 (FIG. 1C) are mounted to the structure or building 16 using the coupler 36. These vertical beams 22 and 24 are attached or secured to the horizontal beams 28 and 30 using the corner key couplers 32. The beams 28 and 30 are attached to each other using the splice coupler 34. Once the beams and couplers 22-36 are coupled together, they define the structure 10. The mesh screen 14*a*, 14*b* may then be secured thereto, thereby providing a structure having a side or large viewing area VA.

FIGS. 9A-12I show the ornamental design of the couplers 32, 34 and 36 and the beam 11, 22, 24, 28, 30 and 92.

Figure 9B:
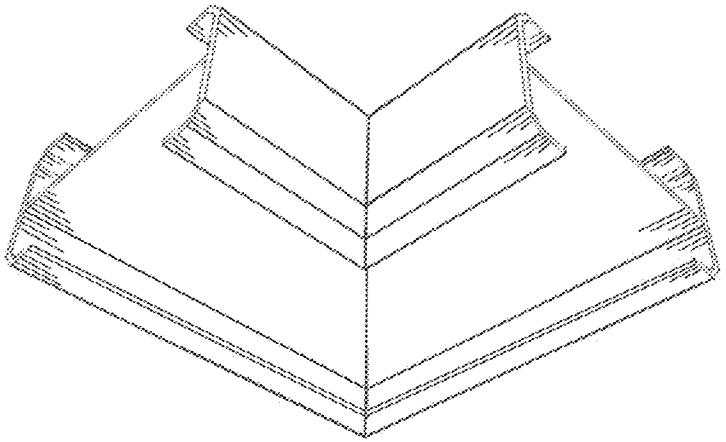
FIGS. 9A-9I are various views showing an ornamental design of a coupler in the form of a corner key or corner coupler.
Figure 9D:
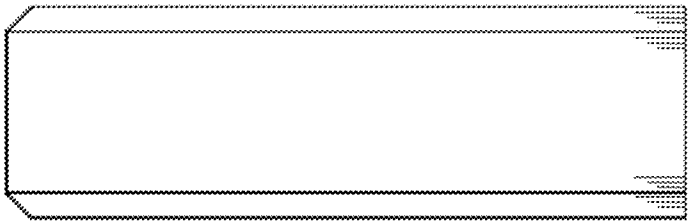
Figure 9A:
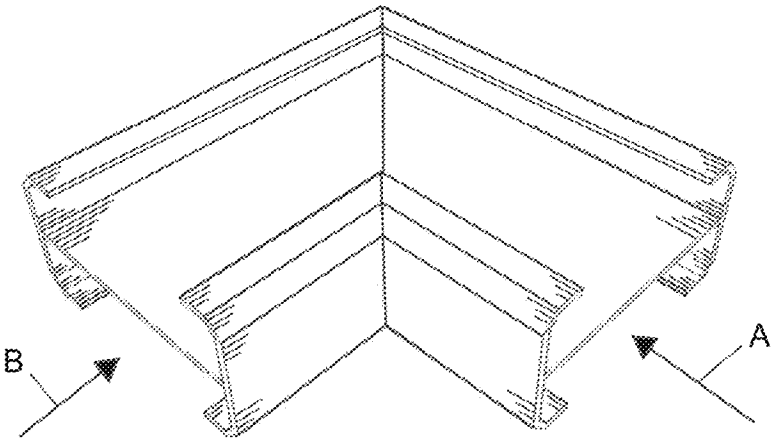
Figure 9C:
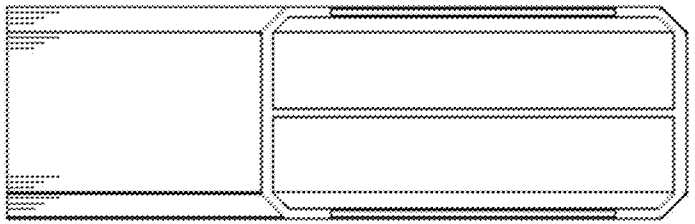
Figure 9F:
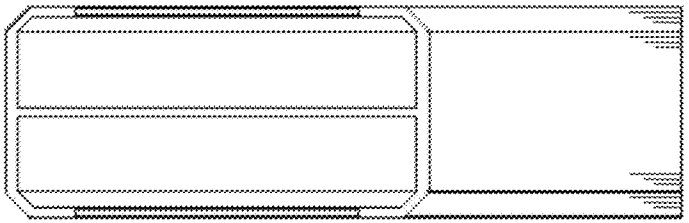
Figure 9E:
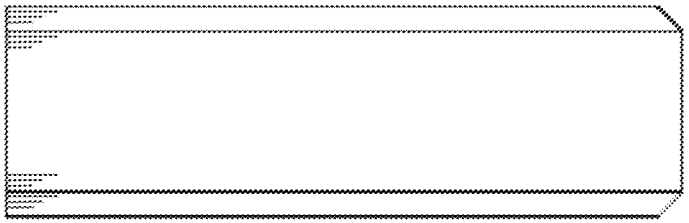
Figure 9I:
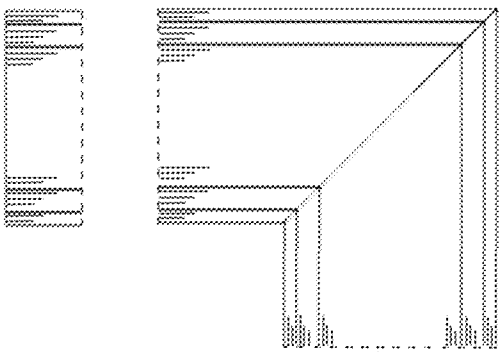
Figure 9H:
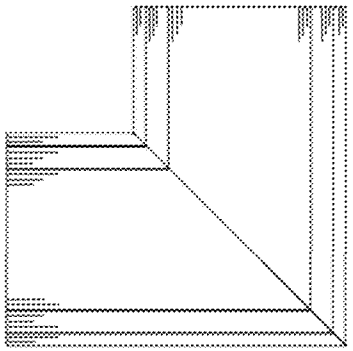
Figure 9G:
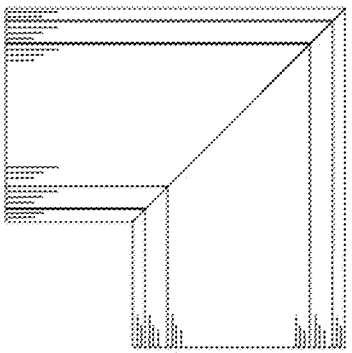

FIG. 9A is a top perspective view of a corner key coupler in accordance with one embodiment of the invention. FIG. 9B is a bottom perspective view of the corner key coupler of FIG. 9A. FIG. 9C is a front view of the corner key coupler of FIG. 9A, viewed in the direction of arrow A in FIG. 9A. FIG. 9D is a rear or back view of the corner key coupler of FIG. 9A. FIG. 9E is a right side view of the corner key coupler of FIG. 9A. FIG. 9F is a left side view of the corner key coupler of FIG. 9A, viewed in the direction of arrow B in FIG. 9A. FIG. 9G is a top view of the corner key coupler of FIG. 9A. FIG. 9H is a bottom view of the corner key coupler of FIG. 9A and FIG. 9I is another top view of the corner key coupler with dashed lines to disclose indefinite length.

Figure 10B:
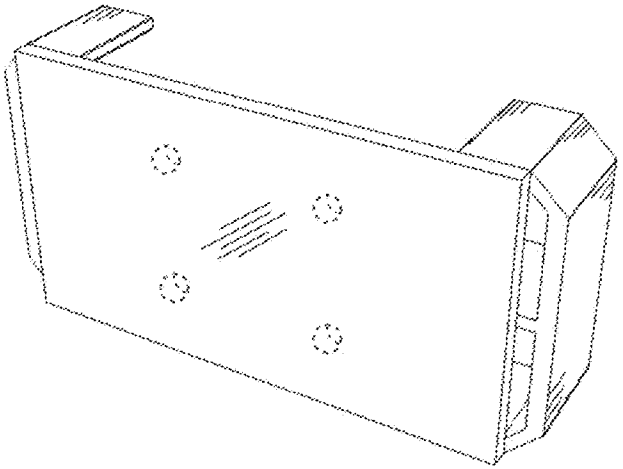
FIGS. 10-10I are various views showing an ornamental design of a coupler in the form of a support coupler.
Figure 10D:
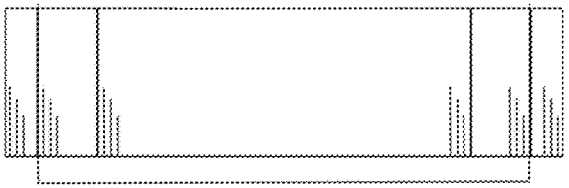
Figure 10F:
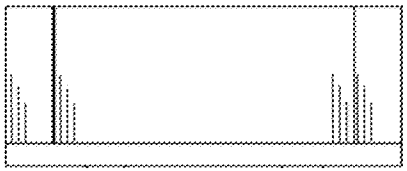
Figure 10A:
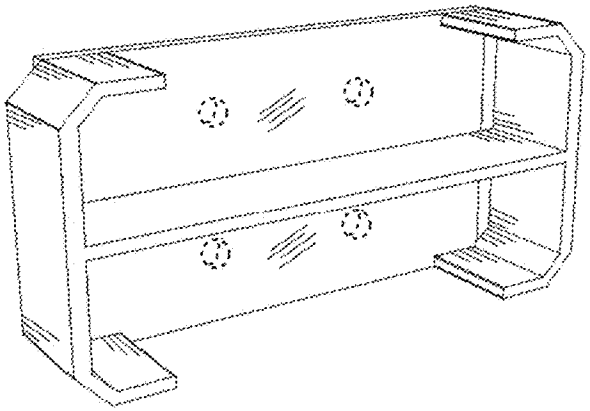
Figure 10C:
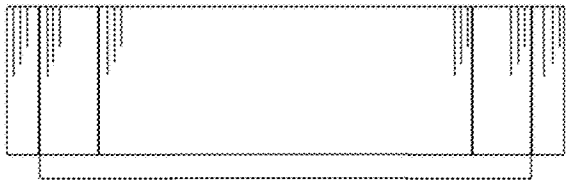
Figure 10E:
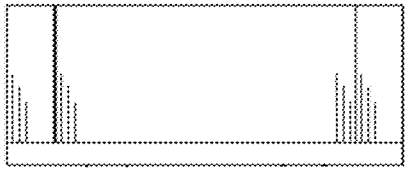
Figure 10H:
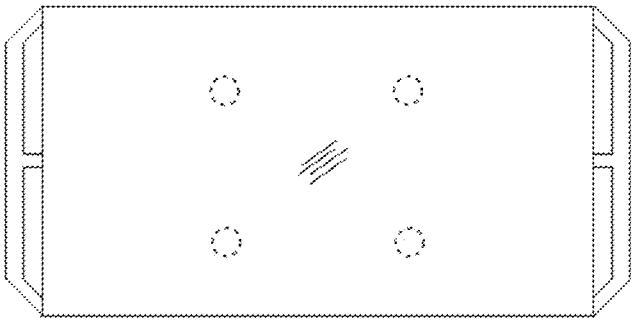
Figure 10G:
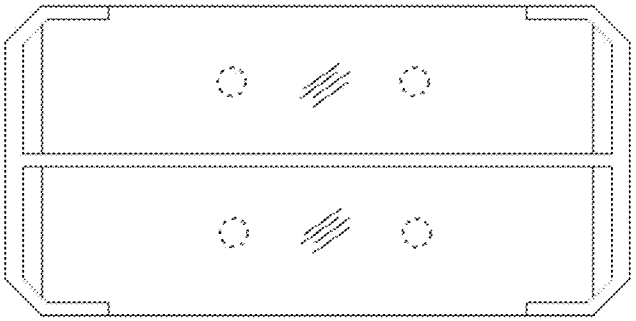
Figure 10I:
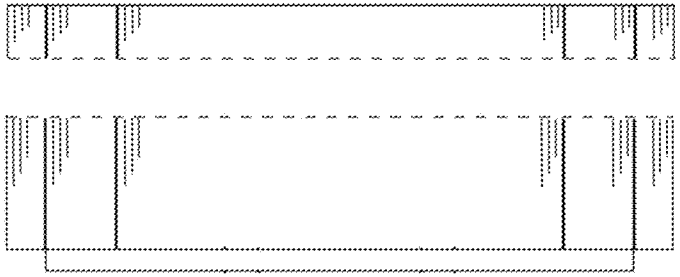

FIG. 10A is a perspective view of an anchor coupler in accordance with another embodiment of the invention. FIG. 10B is another perspective view of the anchor coupler of FIG. 10A. FIG. 10C is a front view of the anchor coupler of FIG. 10A. FIG. 10D is a rear or back view of the anchor coupler of FIG. 10A. FIG. 10E is a right side view of the anchor coupler of FIG. 10A. FIG. 10F is a left side view of the anchor coupler of FIG. 10A. FIG. 10G is a top view of the anchor coupler of FIG. 10A. FIG. 10H is a bottom view of the anchor coupler of FIG. 10A and FIG. 10I is another view of the anchor coupler of FIG. 10A, shown upside down and illustrated with dashed lines to disclose indefinite length.

Figure 11B:
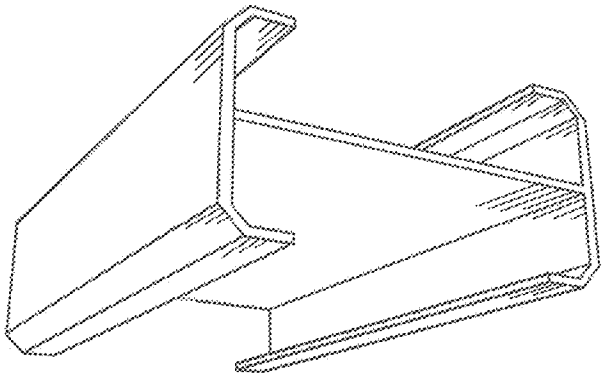
FIGS. 11A-11I are various views showing an ornamental design of a coupler in the form of a splicing coupler.
Figure 11A:
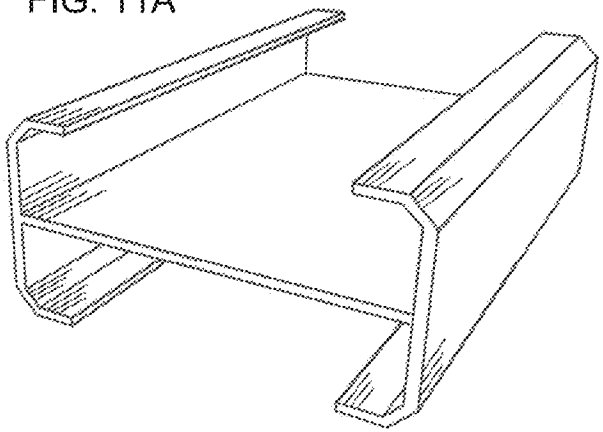
Figure 11D:
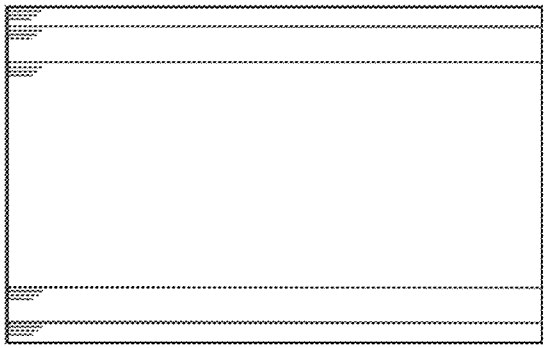
Figure 11C:
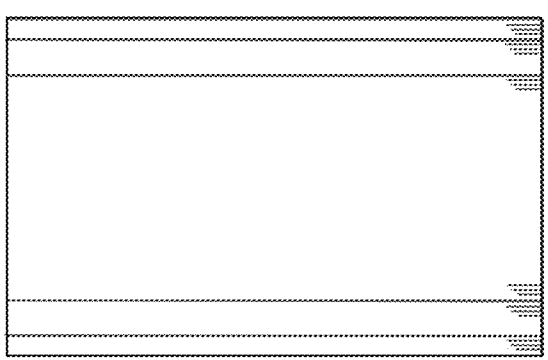
Figure 11F:
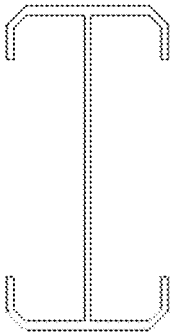
Figure 11H:
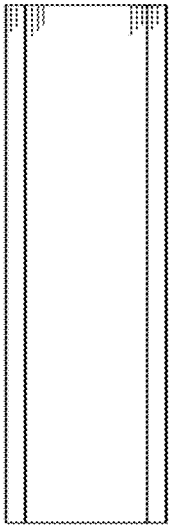
Figure 11I:
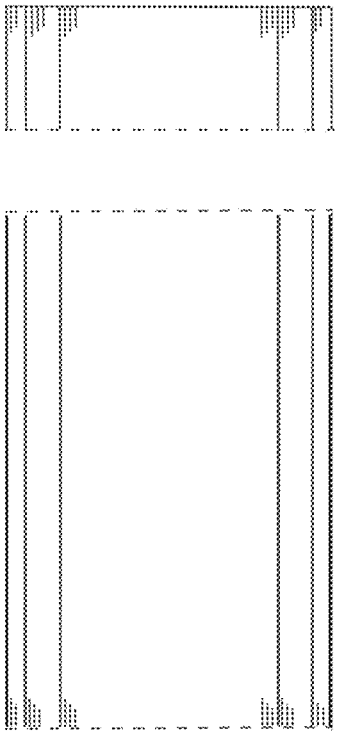
Figure 11E:
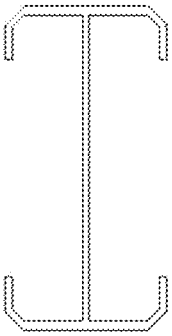
Figure 11G:
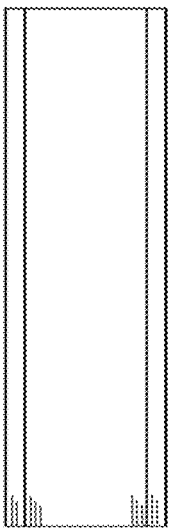

FIG. 11A is a perspective view of a splice coupler in accordance with another embodiment of the invention. FIG. 11B is another perspective view of the splice coupler of FIG. 11A. FIG. 11C is a front view of the splice coupler of FIG. 11A. FIG. 11D is a rear or back view of the splice coupler of FIG. 11A. FIG. 11E is a right side view of the splice coupler of FIG. 11A. FIG. 11F is a left side view of the splice coupler of FIG. 11A. FIG. 11G is a top view of the splice coupler of FIG. 11A. FIG. 11H is a bottom view of the splice coupler of FIG. 11A and FIG. 11I is another top view of the anchor coupler of FIG. 11A with dashed lines to disclose indefinite length.

Figure 12A:
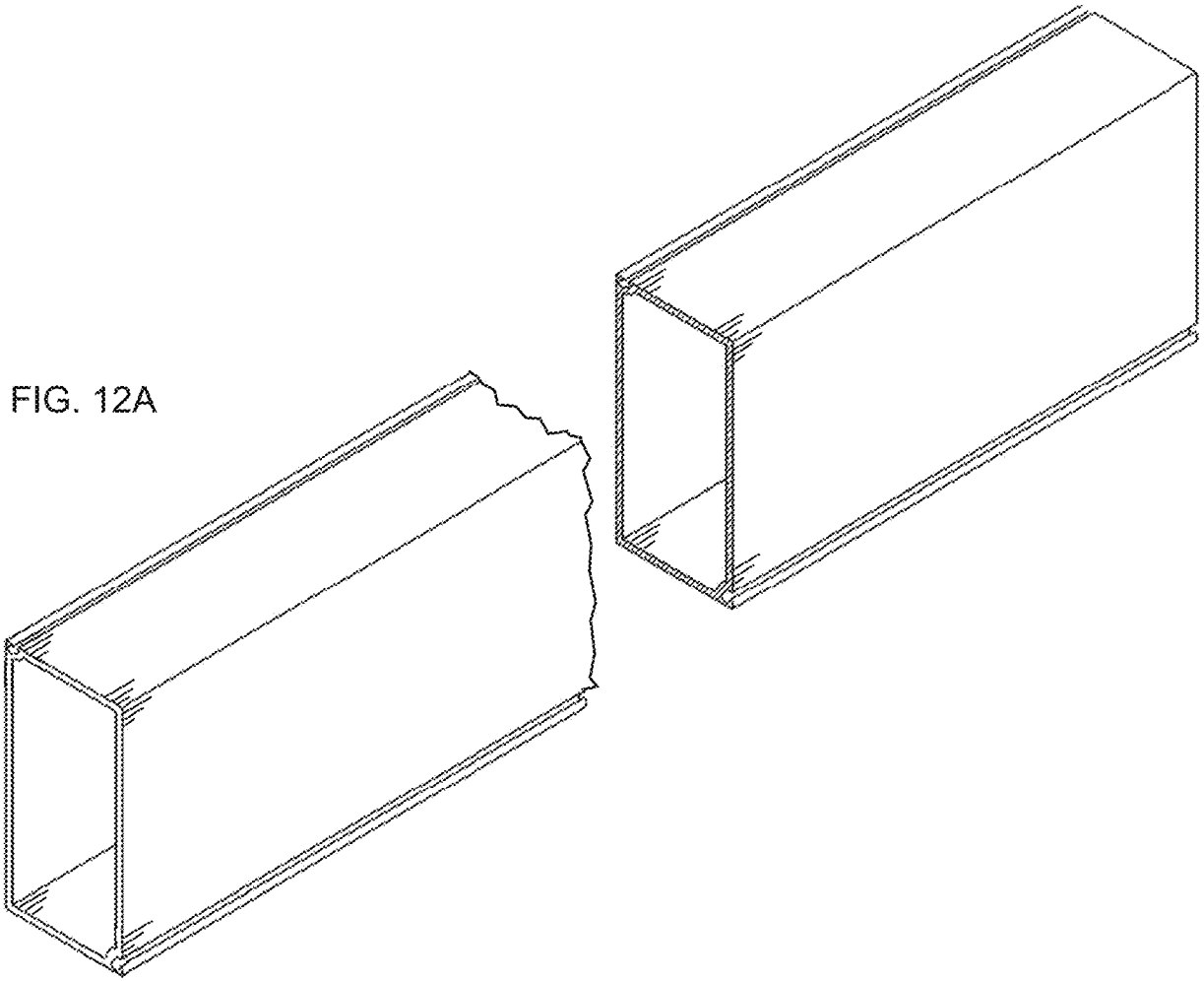
FIGS. 12A-12I are various views showing an ornamental design of a beam used in association with either the corner key coupler, the anchor coupler or the splice coupler.
Figure 12B:
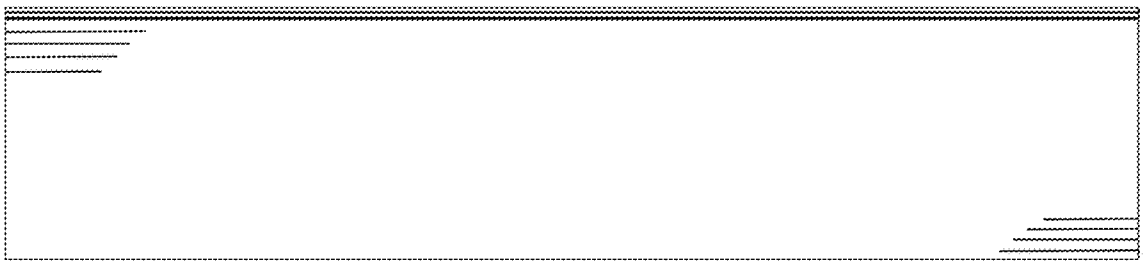
Figure 12C:
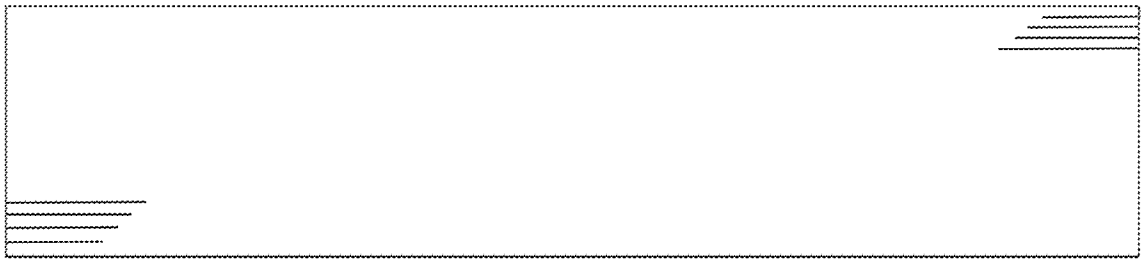
Figure 12D:
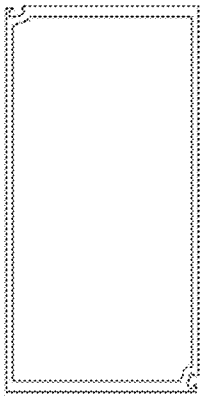
Figure 12E:
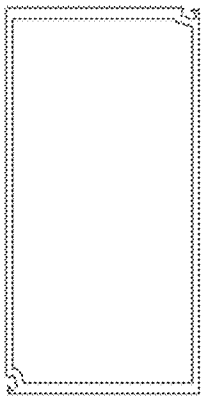
Figure 12F:
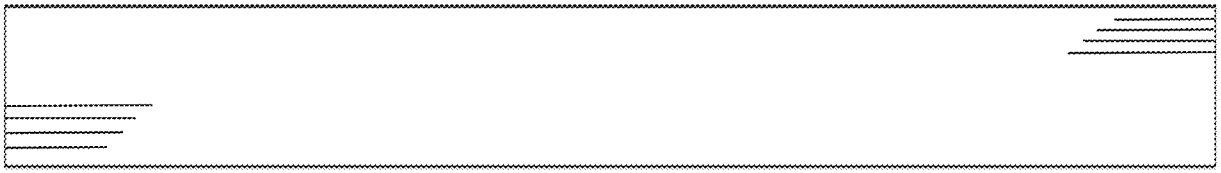
Figure 12G:
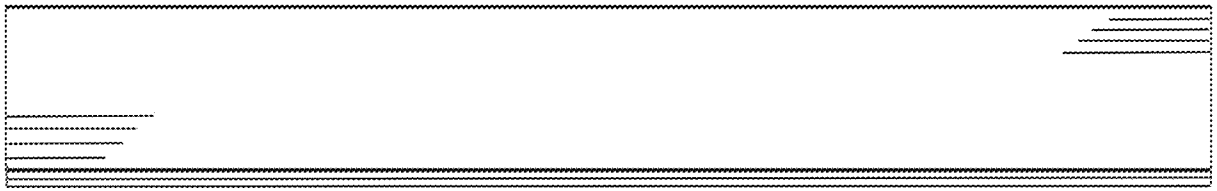
Figure 12H:
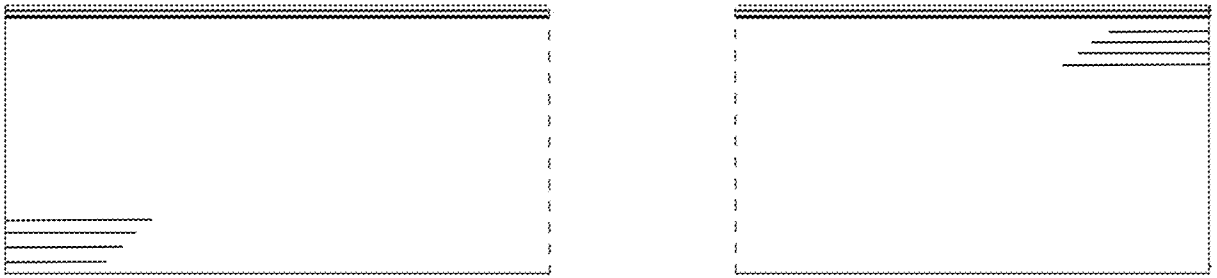
Figure 12I:
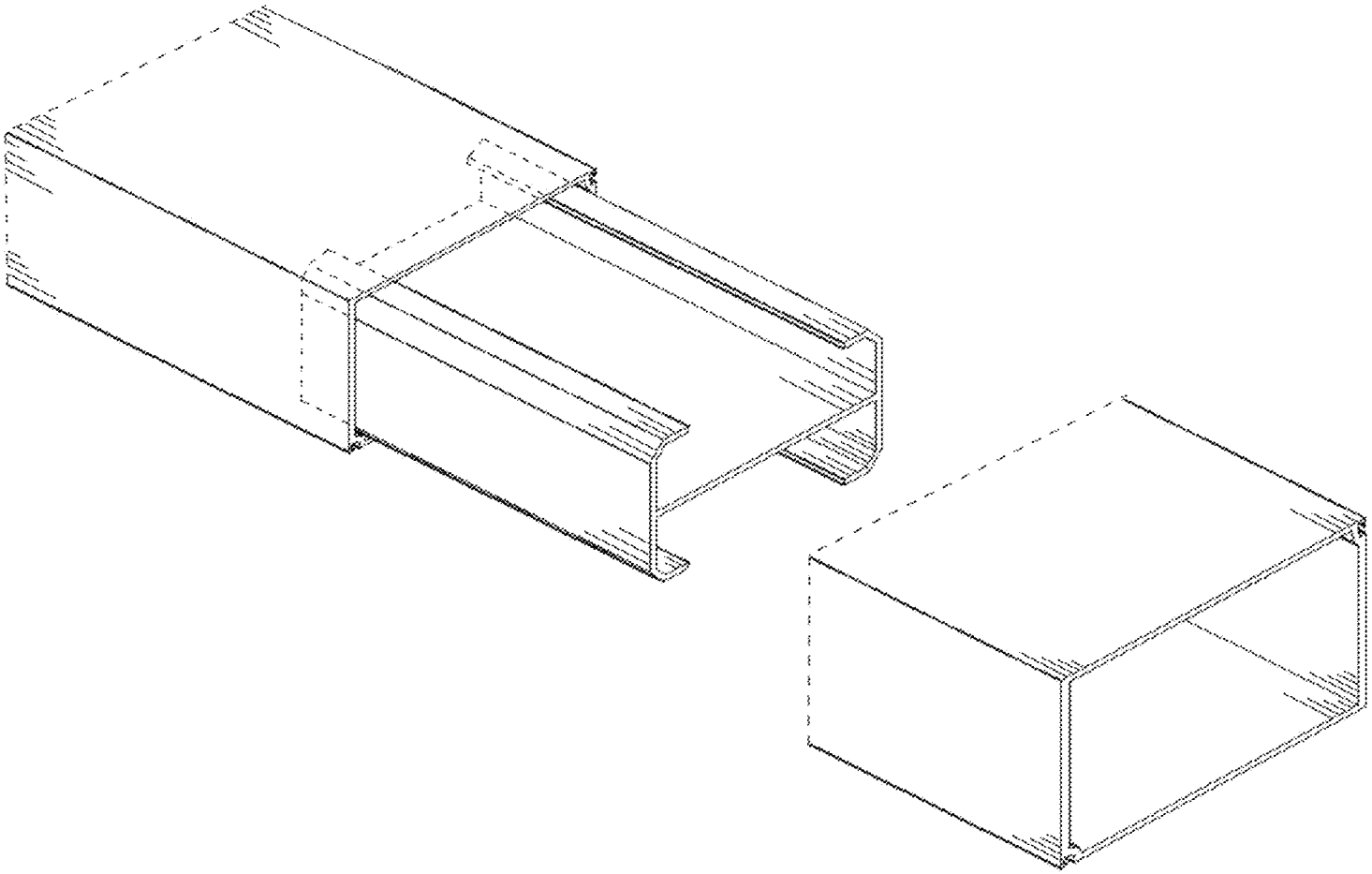

FIG. 12A is a perspective view of a beam used in association with either the corner key coupler, the anchor coupler or the splice coupler with a middle portion broken away to disclose indefinite length. FIG. 12B is a front view of the beam of FIG. 12A. FIG. 12C is a back view of the beam of FIG. 12A. FIG. 12D is a right side view of the beam of FIG. 12A. FIG. 12E is a left side view of the beam of FIG. 12A. FIG. 12F is a top view of the beam of FIG. 12A. FIG. 12G is a bottom view of the beam of FIG. 12A. FIG. 12H is another bottom view of the beam of FIG. 12A with dashed lines to disclose indefinite length and FIG. 12I is a perspective view of the splice coupler in a typical environment illustrating the use of the splice coupler coupling two beams together.

Additional Advantages and Considerations

Some additional advantages and considerations of the embodiments are listed below:

Eliminates need for through-bolts and fascial fasteners.

A length of the couplers 34 and 36 and corner coupler key 32 increases an overall span of beam.

The corner coupler 32 increases lateral support and may reduce or eliminate cable tie downs.

A position of spline groove eliminates need for separate and additional spline beams, such as the prior art 1"×2" beam that was typically mounted on the horizontal support beams.

The coupler 36 can be mounted to any internal coupler including a substrate.

The embodiments can be used with split beams and beams of U.S. Pat. No. 7,877,962; U.S. Design Pat. Nos. D620,618; D620,619; D636,095; D666,743; D713,054 and D791,342.

Design eliminates face screws and also bolts.

The hollow one piece beam having built in spline grooves like those shown in FIG. 3 eliminates the need for additional 1"×2".

The couplers 32, 34 and 36 are not visible once installed in the beams.

An increase in overall strength, spanning length, and robustness is improved by the embodiments being described herein as well as the size, length and other dimensions of the couplers 32, 34 and 36.

The corner coupler 32 bonds and couples beams together to form a corner having plane and unobstructed fascia surfaces, which is aesthetically pleasing.

Advantageously, the embodiments shown and described herein could be used alone or together and/or in combination with one or more of the features covered by one or more of the claims set forth herein, including but not limited to one or more of the features or steps mentioned in the Summary of the Invention and the claims.

While the system, apparatus and method herein described constitute preferred embodiments of this invention, it is to be understood that the invention is not limited to this precise system, apparatus and method, and that changes may be made therein without departing from the scope of the invention which is defined in the appended claims.

What is claimed is:

1. A universal reinforcement coupling for use with at least one support beam used in building a structure for supporting a wall or screen, said coupling comprising:

a body having at least a portion that is sized and adapted for inserting into said at least one support beam, said coupling comprising a plurality of coupling surfaces that become positioned in operative relationship with a plurality of internal surfaces of said at least one support beam; and said at least one support beam being adapted and sized to receive said coupling;

said coupling comprising a first flange, a generally opposing second flange and a web for joining said first and second flanges, wherein said first flange and said second flange each has at least one flange wall that extends generally parallel to said web;

wherein said flange walls of said first and second flanges are spaced from each other along an entire length of said web; and wherein said coupling is configured to be inserted in said at least one support beam to define the structure, said structure generally defining a frame for supporting said wall or screen.

2. The universal reinforcement coupling as recited in claim 1 wherein said coupling is a corner coupler, a splicing coupler or a support coupler.

3. The universal reinforcement coupling as recited in claim 2, wherein each of said support coupler, said splicing coupler and said corner coupler has at least a portion that is generally in the shape of an I in cross-section.

4. The universal reinforcement coupling as recited in claim 2 wherein said coupling comprises at least a portion generally shaped as an I in cross-section, said first and second flanges being generally U-shaped in cross section.

5. The universal reinforcement coupling as recited in claim 4 wherein each of said first and second flanges is generally U-shaped in cross-section and comprises at least one beveled corner.

6. The universal reinforcement coupling as recited in claim 1 wherein said coupling comprises said web, said first flange located on a first end of said web and said second flange located on a second end of said web, each of said first and second flanges being generally perpendicular to said web and generally parallel to each other.

7. The universal reinforcement coupling as recited in claim 6 wherein at least one of said first flange or said second flange has a plurality of flange walls that extend generally parallel to said web and cooperate with a generally planar portion of said first flange or a generally planar portion of said second flange to define a general U-shape in cross-section at each end of said web, said general U-shape of said first flange being generally opposed to said general U-shape of said second flange.

8. The universal reinforcement coupling as recited in claim 1 wherein said coupling is sized and adapted to be received inside an end of said at least one support beam.

9. The universal reinforcement coupling as recited in claim 1 wherein said coupling comprises a beam generally shaped as an I-beam having said first flange and said generally opposing second flange, said first and second flanges each being generally U-shaped in cross section and each comprising a flange having a first flange wall, a second flange wall and a joining flange portion for joining said first and second flange walls, said first and second flange walls having at least one wall surface that becomes generally opposed and adjacent to a first internal beam wall surface and a second internal beam wall surface, respectively.

10. The universal reinforcement coupling as recited in claim 1 wherein at least a portion of said coupling generally defines an I-beam in cross-section, said coupling being generally L-shaped and defines a corner coupler for coupling said at least one support beam to a second support beam such that respective axes of said at least one support beam and said second support beam are not co-axial.

11. The universal reinforcement coupling as recited in claim 1 wherein said coupling is a support coupler and at least a portion of said coupling generally defines an I-beam shape in cross-section having a first end that is received in said at least one support beam and a second end that is fixed or mounted to a support surface, said first end being dimensioned and adapted for receipt in said at least one support beam.

12. The universal reinforcement coupling as recited in claim 1 wherein said coupling is a splice coupler and at least a portion of said coupling comprises said first flange and said generally opposing second flange, said coupling being adapted to splice and support said at least one support beam to a second support beam such that their axes are coaxial and define an elongated beam.

13. The universal reinforcement coupling as recited in claim 1 wherein said at least one support beam comprises an internal beam structure extending at least part of a length into said at least one support beam, at least a portion of said coupling having a predetermined shape to cooperate with at least one internal surface of said at least one support beam to define an aperture into which said internal beam structure may be received.

14. The universal reinforcement coupling as recited in claim 13 wherein at least a portion of said coupling generally has said first flange and said generally opposing second flange, said first and second flanges having at least one recessed area, beveled corner or edge adapted to cooperate with at least one wall of said at least one support beam to define an internal channel.

15. A building system comprising:

at least one support beam used in building a structure for supporting a wall or screen, said at least one support beam having a plurality of beam walls defining a plurality of internal wall surfaces, respectively, that cooperate to define a beam aperture; and at least one coupling adapted and dimensioned to be received in said beam aperture, said at least one coupling comprising a plurality of coupling surfaces that become positioned in operative relationship with said plurality of internal wall surfaces, respectively, of said at least one support beam to facilitate enhancing a performance or characteristic of said at least one support beam;

wherein said at least one coupling comprises a first flange, a generally opposing second flange and a web for joining said first and second flanges, wherein said first flange and said second flange each has at least one flange wall that extends generally parallel to said web;

wherein said flange walls of said first and second flanges are spaced from each other along an entire length of said web; and wherein said at least one coupling is inserted in said at least one support beam and defines the structure, said structure generally defining a frame for supporting said wall or screen.

16. The building system as recited in claim 15 wherein said at least one coupling is a corner coupler, a splicing coupler or a support coupler.

17. The building system as recited in claim 15 wherein at least a portion of said at least one coupling generally defines an I shape in cross-section adapted and dimensioned to be inserted in said at least one support beam.

18. The building system as recited in claim 15 wherein at least a portion of said at least one coupling has at least a portion that is generally shaped like an I-beam having said first flange, said generally opposing second flange and said web coupling said first and second flanges, said first and second flanges being generally U-shaped in cross section and each comprising a first flange wall, a second flange wall and a flange joining portion for joining said first and second flange walls;

said plurality of internal wall surfaces comprising a first internal beam wall surface, a second internal beam wall surface and a third internal beam wall surface; and said first and second flange walls each having at least one surface that becomes generally opposed or adjacent to said first internal beam wall surface and said second internal beam wall surface, respectively, said flange joining portion becoming generally opposed or adjacent said third internal beam wall surface.

19. The building system as recited in claim 15 wherein at least a portion of said at least one coupling defines an I-beam configuration in cross-section and said at least one coupling is generally L-shaped to define a corner coupler for coupling said at least one support beam to a second beam.

20. The building system as recited in claim 15 wherein said at least one coupling is a support coupler having a first end having at least a portion that defines a generally I-beam shape that is received in said at least one support beam and a second end that is fixed or mounted to a support surface.

21. The building system as recited in claim 15 wherein said at least one coupling has said first flange and said generally opposing second flange, at least one of said first and second flanges being generally U-shaped in cross section, said at least one coupling being a splice coupler adapted to splice together said at least one support beam to a second support beam.

22. The building system as recited in claim 15 wherein said at least one support beam comprises an internal beam structure extending at least part of a length of said at least one support beam, said at least one coupling having a predetermined shape to cooperate with at least one of said plurality of internal wall surfaces of said at least one support beam to define an aperture into which said internal beam structure may be received.

23. The building system as recited in claim 22 wherein said internal beam structure is a retaining channel or spline groove.

24. The building system as recited in claim 22 wherein said at least one coupling comprises at least a portion that defines a general I-beam shape having at least one of the first flange or second flange having at least one beveled corner or edge that defines said predetermined shape.

25. The building system as recited in claim 15 wherein said at least one coupling comprises at least a portion having a general shape of an I-beam with said first flange and said second flange, at least one of said first flange or second flange having at least one truncated or beveled corner adapted to accommodate an internal beam structure on at least one of said plurality of internal wall surfaces.

26. The building system as recited in claim 15 wherein said at least one coupling comprises an I-beam and has a first portion and a second portion;

a dimension or size of at least one of said first portion or said second portion being selected in response to a dimension or size of said at least one support beam.

27. The building system as recited in claim 15 wherein said at least one coupling comprises a first portion having a first axis and a second portion having a second axis, said first and second axes being angled a predetermined angle with respect to each other.

28. The building system as recited in claim 15 wherein said building system comprises at least one fastener for securing said at least one support beam to said at least one coupling, said at least one fastener passing through only one of said plurality of beam walls before engaging said at least one coupling and does not pass through another of said plurality of beams walls.

29. The building system as recited in claim 28 wherein said at least one fastener comprises a plurality of fasteners and said plurality of beam walls defines a plurality of fascia walls and a plurality of non-fascia or end walls, each of said plurality of fasteners comprising being mounted in one of said plurality of non-fascia or end walls and not any of said plurality of fascia walls.

30. The building system as recited in claim 15 wherein a length of said at least one support beam is directly related to at least one dimension of at least a portion of said at least one coupling that is received in said at least one support beam.

31. The building system as recited in claim 15 wherein said at least one coupling is a corner coupler dimensioned and adapted to provide a corner coupling of said at least one support beam having a coupling strength that eliminates a need for any cable tie downs.

32. The building system as recited in claim 15 wherein each of said at least one support beam has a plurality of spline grooves adapted to receive a spline for securing a screen onto said support beam.

33. The building system as recited in claim 32 wherein said plurality of spline grooves comprise a first spline groove situated on a first end wall of each of said at least one support beam and a second spline groove situated on a side fascia wall of each of said at least one support beam.

34. The building system as recited in claim 15 wherein said at least one coupling comprises an insert end for inserting into at least one of said at least one support beam and a mounting end for mounting to a surface or substrate.

35. A coupling for use with at least one support beam of a building structure for supporting a wall or screen, said coupling comprising:

a body having at least a portion that is sized and adapted to fit into at least one end of said at least one support beam and to engage internal walls thereof in order to buttress or support said at least one support beam;

said body comprising a web having a first flange on a first end of said web and a second flange on a second end of said web;

said first and second flanges each having a primary flange surface and at least one flange wall surface integrally or monolithically formed with said primary flange surface;

wherein said at least one flange wall surface being generally perpendicular to said primary flange surface;

wherein said flange wall surfaces of said first and second flanges are spaced from each other along an entire length of said web; and wherein said coupling is inserted in said at least one support beam and defines the structure, said structure generally defining a frame for supporting said wall or screen.

36. The coupling as recited in claim 35 wherein said coupling is a corner coupler, a splicing coupler or a support coupler.

37. The coupling as recited in claim 36, wherein each of said support coupler, said splicing coupler and said corner coupler has at least a portion that is generally in the shape of an I in cross-section.

38. The coupling as recited in claim 35 wherein each of said at least one flange wall surface comprises a first flange wall surface and a second flange wall surface, both of which project from said primary flange surface, said primary flange surface and said at least one first and second flange wall surfaces cooperating to define a general U-shape.

39. The coupling as recited in claim 38 wherein said coupler comprises a beveled, angled or curved wall surface that joins or couples said first and second flange wall surfaces and said primary flange surface.

40. The coupling as recited in claim 39 wherein said beveled, angled or curved wall surface cooperates with at least one internal surface of said at least one support beam to define an elongated aperture for accommodating or receiving an internal beam structure of said at least one support beam.

41. A building system comprising:

at least one support beam used in building a structure for supporting a wall or screen, said at least one support beam having a plurality of beam walls defining a plurality of internal wall surfaces, respectively, that cooperate to define a beam aperture; and at least one coupling adapted and dimensioned to be received in said beam aperture, said at least one coupling comprising a plurality of coupling surfaces positioned in operative relationship with said plurality of internal wall surfaces, respectively, of said at least one support beam to facilitate enhancing a performance or characteristic of said at least one support beam;

wherein said at least one coupling is a corner coupler, a splicing coupler, or a support coupler;

wherein said at least one coupling comprises a first flange, a generally opposing second flange and a web for joining said first and second flanges, wherein said first flange and said second flange each has at least one flange wall that extends generally parallel to said web;

wherein said flange walls of said first and second flanges are spaced from each other along an entire length of said web; and wherein said at least one coupling is inserted in said at least one support beam and defines the structure, said structure generally defining a frame for supporting said wall or screen.

* * * * *